US009157183B2

(12) United States Patent
Amatani et al.

(10) Patent No.: US 9,157,183 B2
(45) Date of Patent: Oct. 13, 2015

(54) TREATMENT COMPOSITION FOR TEXTILE GOODS

(71) Applicant: LION Corporation, Tokyo (JP)

(72) Inventors: Tomohiko Amatani, Tokyo (JP); Eiji Ogura, Tokyo (JP); Ryo Hashimoto, Tokyo (JP); Rie Adachi, Tokyo (JP); Emiko Hashimoto, Tokyo (JP); Naoyuki Egawa, Tokyo (JP)

(73) Assignee: LION CORPORATION, Tokyo (JP)

( * ) Notice: Subject to any disclaimer, the term of this patent is extended or adjusted under 35 U.S.C. 154(b) by 0 days.

(21) Appl. No.: 14/403,361

(22) PCT Filed: May 27, 2013

(86) PCT No.: PCT/JP2013/064645

§ 371 (c)(1),
(2) Date: Nov. 24, 2014

(87) PCT Pub. No.: WO2013/176288

PCT Pub. Date: Nov. 28, 2013

(65) Prior Publication Data

US 2015/0159318 A1 Jun. 11, 2015

(30) Foreign Application Priority Data

| | | |
|---|---|---|
| May 25, 2012 | (JP) | 2012-119207 |
| Aug. 27, 2012 | (JP) | 2012-186625 |
| Sep. 21, 2012 | (JP) | 2012-208334 |
| Oct. 15, 2012 | (JP) | 2012-227874 |

(51) Int. Cl.

| | |
|---|---|
| ***D06M 15/03*** | (2006.01) |
| ***D06M 13/328*** | (2006.01) |
| ***D06M 13/144*** | (2006.01) |
| ***D06M 13/463*** | (2006.01) |
| ***D06M 13/188*** | (2006.01) |
| ***D06M 15/643*** | (2006.01) |
| ***D06M 15/687*** | (2006.01) |

(52) U.S. Cl.

CPC ..... *D06M 15/687* (2013.01); *D06M 13/144* (2013.01); *D06M 13/188* (2013.01); *D06M 13/328* (2013.01); *D06M 13/463* (2013.01); *D06M 15/03* (2013.01); *D06M 15/643* (2013.01)

(58) Field of Classification Search

CPC ..... D06M 13/144; D06M 13/188; D06M 13/328; D06M 13/463; D06M 15/03; D06M 15/643; D06M 15/687

USPC ..... 252/8.61

See application file for complete search history.

(56) References Cited

U.S. PATENT DOCUMENTS

| | | | |
|---|---|---|---|
| 5,955,093 | A | 9/1999 | Woo et al. |
| 6,033,679 | A | 3/2000 | Woo et al. |
| 6,248,566 | B1 | 6/2001 | Imanaka et al. |
| 6,573,233 | B1 | 6/2003 | Altmann et al. |

FOREIGN PATENT DOCUMENTS

| | | | |
|---|---|---|---|
| JP | 8-134104 | A | 5/1996 |
| JP | 2002-504837 | A | 2/2002 |
| JP | 2003-525356 | A | 8/2003 |
| JP | 2007-332130 | A | 12/2007 |
| JP | 2009-057647 | A | 3/2009 |
| WO | 2009/075284 | A1 | 6/2009 |

*Primary Examiner* — Anthony J Green

(74) *Attorney, Agent, or Firm* — Nath, Goldberg & Meyer; Joshua B. Goldberg; Scott Blackman

(57) ABSTRACT

The present invention provides a treatment agent composition for fiber products capable of producing an exceptional odor-eliminating and odor-preventing effect against various odors. This treatment agent composition for fiber products comprises: (A) highly branched cyclic dextrin; (B) at least one compound selected from the group consisting of an amine compound having within each molecule one to three $C_{10-26}$ hydrocarbon groups optionally split with an ester group or an amide group, a salt of the amine compound, and a quaternized form of the amine compound; and (C) at least one compound selected from (C-1)-(C-3) below: (C-1) a fatty acid expressed by $R^aCOOH$ ($R^a$ is a fatty acid represented by a $C_{8-35}$ alkyl or alkenyl group), (C-2) a silicone compound, and (C-3) an aliphatic alcohol represented by $R^bOH$ ($R^b$ is an aliphatic alcohol represented by a $C_{8-35}$ alkyl or alkenyl group).

13 Claims, No Drawings

TREATMENT COMPOSITION FOR TEXTILE GOODS

This is a National Phase Application filed under 35 U.S.C. 371 as a national stage of PCT/JP2013/064645, filed on May 27, 2013, an application claiming the benefit from Japanese Application No. 2012-119207, filed on May 25, 2012, Japanese Application No. 2012-186625, filed on Aug. 27, 2012, Japanese Application No. 2012-208334, filed on Sep. 21, 2012, and Japanese Application No. 2012-227874, filed on Oct. 15, 2012, the entire content of each of which is hereby incorporated by reference in its entirety.

TECHNICAL FIELD

The present invention relates to a treatment composition for textile goods, in particular to a treatment composition suitably used for textile goods such as clothes and the like. More particularly, the invention relates to a treatment composition for textile goods that is excellent in the deodorizing and odor prevention effects.

BACKGROUND ART

For removing offensive odors from textile goods and preventing the textile goods from smelling bad, various trials have conventionally been made to reduce the offensive odors by means of sensuous deodorization, physical deodorization, chemical deodorization, biological deodorization and the like. Although technical improvements have been still introduced, there is no satisfactory solution for deodorization in the present circumstances. Therefore, the need for more effective deodorization of textile goods has been still high.

The respective deodorizing or odor preventing methods are based on different deodorizing or odor preventing mechanisms. For example, the sensuous deodorization is a method to make a person insensitive to offensive odors by taking advantage of fragrance or the like. However, some offensive odors may become more striking. The physical deodorization is a method to prevent the release of bad smells by trapping the odor constituting ingredients into some molecules or pores existing on the base material. However, silica and cyclodextrin, which are conventionally used for physical deodorization may not work to take in the ingredients of bad odors in some cases. The chemical deodorization is a method to cause a chemical reaction with the ingredients constituting bad odors, thereby weakening the malodors or converting the odor-constituting ingredients into odor-free ingredients. However, bad odors have various ingredients, some of which may not be subject to any chemical reaction. The biological deodorization is a method to control bad odors resulting from decomposition of sweat or the like by decreasing the number of bacteria and preventing the growth of bacteria on the skin. However, this method does not work when the bacteria or the like are not involved in the bad smells.

SUMMARY OF INVENTION

An object of the invention is to provide a treatment composition for textile goods that can provide excellent effects of removing and preventing a variety of offensive odors.

The inventors have found that excellent deodorizing and odor preventing effects against a variety of offensive odors can be obtained by adding to a treatment composition for textile goods highly branched cyclic dextrin, that is, a particular glucan classified as one base material for physical deodorization, and applying the resultant treatment composition to textiles.

Generally, a cationic base is contained in the treatment composition for textile goods in order to apply some functional substances to the textile goods in the course of washing. It has been found that further addition of a hydrophobic compound such as a fatty acid or the like can still more improve the deodorizing and odor preventing effects of the above-mentioned highly branched cyclic dextrin.

The invention has been accomplished based on the novel findings as mentioned above.

According to one aspect of the invention, there is provided a treatment composition for textile goods, comprising;

(A) a glucan having an inner branched cyclic structure portion and an outer branched structure portion and having a degree of polymerization of 50 to 10,000, the inner branched cyclic structure portion being a cyclic structure portion formed from α-1,4-glucosidic bond and α-1,6-glucosidic bond, and the outer branched structure portion being a non-cyclic structure portion attached to the inner branched cyclic structure portion, (B) at least one compound selected from the group consisting of: an amine compound having in the molecule thereof 1 to 3 hydrocarbon groups with 10 to 26 carbon atoms, which may be separated by an ester group or an amide group; a salt thereof; and a quaternary compound thereof, and (C) one or two or more compounds selected from the following compounds (C-1) to (C-3):

(C-1): a fatty acid represented by $R^aCOOH$ wherein $R^a$ is an alkyl or alkenyl group having 8 to 35 carbon atoms, (C-2): a silicone compound, and (C-3): an aliphatic alcohol represented by $R^bOH$ wherein $R^b$ is an alkyl or alkenyl group having 8 to 35 carbon atoms.

In one aspect of the invention, the ratio by mass of the component (A) to the component (B), i.e., (A)/(B) may be 1/1000 to 1/1, and the ratio by mass of the component (A) to the component (C), i.e., (A)/(C) may be 1/100 to 100/1.

In one aspect of the invention, the component (C) may comprise the component (C-1), and the component (C-2) and/or the component (C-3).

In one aspect of the invention, the component (C) may comprise the component (C-2), which is selected from the group consisting of polyether-modified silicone, amino-modified silicone and dimethyl silicone.

In the treatment composition for textile goods according to one embodiment of the invention, excellent deodorizing and odor preventing effects can be obtained by the highly branched cyclic dextrin contained therein as the component (A). Further, the combination of the component (A) with a surfactant as the component (B) and a hydrophobic compound as the component (C) can still more improve the deodorizing and odor preventing effects.

In one aspect of the invention, the treatment composition for textile goods may further comprise (D) a water-soluble solvent selected from the group consisting of:

(i) alkanols,
(ii) polyols,
(iii) polyglycols,
(iv) alkylethers,
(v) aromatic ethers, and
(vi) alkanolamines, with the ratio of (A)/(D) being in the range of 10/1 to 1/100.

In one aspect of the invention, the component (D) may comprise the above-mentioned alkanol (i) and other water-soluble solvents selected from the group consisting of (ii) to (vi).

In one aspect of the invention, the treatment composition for textile goods may further comprise (E) a sugar compound having a degree of polymerization of 40 or less.

In one aspect of the invention, the treatment composition for textile goods may further comprise (F) an antioxidant.

In one aspect of the invention, the component (F) may be contained in an amount of 0.001 to 5 mass %, and the component (A) may be contained in an amount of 0.01 to 10 mass %, with the ratio of (F)/(A) being 5 or less.

In one aspect of the invention, the component (F) may be a phenol antioxidant.

In one aspect of the invention, the component (F) may be 3,5-di-t-butyl-4-hydroxytoluene (BHT), p-methoxyphenol or 2,2'-ethylidenebis(4,6-di-t-butylphenol).

In one aspect of the invention, the treatment composition for textile goods may further comprise (G) a biguanide compound.

According to one embodiment of the invention, the treatment composition for textile goods may be a softener composition.

According to another aspect of the invention, there is provided a treatment composition for textile goods, comprising;

(A) a glucan having an inner branched cyclic structure portion and an outer branched structure portion and having a degree of polymerization of 50 to 10,000, the inner branched cyclic structure portion being a cyclic structure portion formed from α-1,4-glucosidic bond and α-1,6-glucosidic bond, and the outer branched structure portion being a non-cyclic structure portion attached to the inner branched cyclic structure portion, (B) at least one compound selected from the group consisting of: an amine compound having in the molecule thereof 1 to 3 hydrocarbon groups with 10 to 26 carbon atoms, which may be separated by an ester group or an amide group; a salt thereof; and a quaternary compound thereof, and (D) a water-soluble solvent selected from the group consisting of:

(i) alkanols, (ii) polyols, (iii) polyglycols, (iv) alkylethers, (v) aromatic ethers, and (vi) alkanolamines, with the ratio of (A)/(D) being in the range of 10/1 to 1/100.

In the above-mentioned aspect of the invention, the component (D) may comprise the above-mentioned alkanol (i) and other water-soluble solvents selected from the group consisting of (ii) to (vi).

In the above-mentioned aspect of the invention, the treatment composition for textile goods may further comprise (E) a sugar compound having a degree of polymerization of 40 or less.

In the treatment composition for textile goods according to one embodiment of the invention, excellent deodorizing and odor preventing effects can be obtained by the highly branched cyclic dextrin contained therein as the component (A). Furthermore, an addition of the particular water-soluble solvent as the component (D) leads to maintaining the viscosity for an extended period of time, thereby preventing decrease of the usability, and at the same time, making the deodorizing and odor preventing effects last longer.

According to another aspect of the invention, there is provided a treatment composition for textile goods, comprising;

(F) an antioxidant, and (A) a glucan having an inner branched cyclic structure portion and an outer branched structure portion and having a degree of polymerization of 50 to 10,000, the inner branched cyclic structure portion being a cyclic structure portion formed from α-1,4-glucosidic bond and α-1,6-glucosidic bond, and the outer branched structure portion being a non-cyclic structure portion attached to the inner branched cyclic structure portion.

In the above-mentioned aspect of the invention, the component (F) may be contained in an amount of 0.001 to 5 mass %, and the component (A) may be contained in an amount of 0.01 to 10 mass %, with the ratio of (F)/(A) being 5 or less.

In the above-mentioned aspect of the invention, the component (F) may be a phenol antioxidant.

In the above-mentioned aspect of the invention, the component (F) may be 3,5-di-t-butyl-4-hydroxytoluene (BHT), p-methoxyphenol or 2,2'-ethylidenebis(4,6-di-t-butylphenol).

In the above-mentioned aspect of the invention, the treatment composition for textile goods may further comprise a nonionic surfactant.

In the above-mentioned aspect of the invention, the nonionic surfactant may be polyoxyalkylene alkyl ether which has an alkyl or alkenyl group with 8 to 36 carbon atoms and in which the average addition molar number of an alkylene oxide having 2 to 4 carbon atoms is 5 to 100.

In the above-mentioned aspect of the invention, the treatment composition for textile goods may further comprise at least one of a cationic surfactant, amphoteric surfactant or anionic surfactant.

According to another embodiment of the invention, there is provided a spray type fabric treatment wherein the treatment composition for textile goods is filled into a spray container.

In the treatment composition for textile goods according to one embodiment of the invention, a preventing effect on the color change of the antioxidant-containing composition can be obtained by the highly branched cyclic dextrin contained therein as the component (A).

According to another aspect of the invention, there is provided a treatment composition for textile goods, comprising;

(A) a glucan having an inner branched cyclic structure portion and an outer branched structure portion and having a degree of polymerization of 50 to 10,000, the inner branched cyclic structure portion being a cyclic structure portion formed from α-1,4-glucosidic bond and α-1,6-glucosidic bond, and the outer branched structure portion being a non-cyclic structure portion attached to the inner branched cyclic structure portion, and (G) a biguanide compound.

In the above-mentioned aspect of the invention, the treatment composition for textile goods may further comprise a cationic surfactant.

In the treatment composition for textile goods according to one embodiment of the invention, excellent deodorizing and odor preventing effects can be obtained by the highly branched cyclic dextrin contained therein as the component (A), and the thus obtained deodorizing and odor preventing effects can be maintained even after the storage by using the biguanide compound as the component (G) in combination. Furthermore, by an addition of a cationic surfactant, the odor preventing performance can be enhanced and excellent soft feel can be imparted to the textile goods.

DESCRIPTION OF EMBODIMENTS

[Component (A)]

The component (A) contained in the treatment composition for textile goods according to one embodiment of the invention is a glucan having an inner branched cyclic structure portion and an outer branched structure portion and having a degree of polymerization of 50 to 10,000, the inner branched cyclic structure portion being a cyclic structure portion formed from α-1,4-glucosidic bond and α-1,6-glucosidic bond, and the outer branched structure portion being a non-cyclic structure portion attached to the inner branched cyclic structure portion. The glucan as mentioned above is generally called highly branched cyclic dextrin or cluster dextrin, and also hereinafter referred to as the highly branched cyclic dextrin.

The highly branched cyclic dextrin that is contained in the treatment composition for textile goods according to one embodiment of the invention has a molecular weight of about 30,000 to about 1,000,000, and comprises predominantly a dextrin, with a weight average degree of polymerization of about 2,500, having one cyclic structure in the molecule thereof and a number of glucan chains bonded to the cyclic structure.

The inner branched cyclic structure portion of the highly branched cyclic dextrin that is contained in the treatment composition for textile goods according to one embodiment of the invention is composed of about 10 to about 100 glucose units, to which inner branched cyclic structure portion a number of non-cyclic branched glucan chains are bonded.

By way of example, the highly branched cyclic dextrin contained in the treatment composition for textile goods according to one embodiment of the invention may have a degree of polymerization of 50 to 5,000.

By way of example, the inner branched cyclic structure portion of the highly branched cyclic dextrin contained in the treatment composition for textile goods according to one embodiment of the invention may have a degree of polymerization of 10 to 100.

By way of example, the outer branched structure portion of the highly branched cyclic dextrin contained in the treatment composition for textile goods according to one embodiment of the invention may have a degree of polymerization of 40 or more.

By way of example, in the outer branched structure portion of the highly branched cyclic dextrin contained in the treatment composition for textile goods according to one embodiment of the invention, each unit chain may have a degree of polymerization of 10 to 20 on average.

The highly branched cyclic dextrin contained in the treatment composition for textile goods according to one embodiment of the invention may be prepared, for example, by allowing an enzyme, i.e., a branching enzyme to react with a starch as the raw material. The starch as the raw material comprises amylose having a linear chain structure made up of glycose units linked by α-1,4-glycosidic bond; and amylopectin having a highly branched structure by α-1,6-glycosidic bond. The amylopectin is a macromolecule made up of a great number of cluster structures. The branching enzyme used is a glucan chain transferase widely distributed in plants, animals and microorganisms, which acts on the bonds of cluster structures of amylopectin and catalyzes the cyclic reaction thereof.

More particularly, the highly branched cyclic dextrin contained in the treatment composition for textile goods according to one embodiment of the invention is a glucan having an inner branched cyclic structure portion and an outer branched structure portion and having a degree of polymerization of 50 to 10,000, as described in JP (Hei) 8-134104 A. The term "highly branched cyclic dextrin" herein used can be understood in view of the description of JP (Hei) 8-134104 A.

Unlike the general cyclodextrin having 6 to 8 glucose units linked, such as α-cyclodextrin (n=6), β-cyclodextrin (n=7), γ-cyclodextrin (n=8) or the like, the highly branched cyclic dextrin contained in the treatment composition for textile goods according to tone embodiment of the invention has the particular structure as mentioned above, and shows a higher degree of polymerization (i.e., larger molecular weight).

As a specific example of the highly branched cyclic dextrin contained in the treatment composition for textile goods according to one embodiment of the invention, a commercially available product "Cluster Dextrin (registered trademark)" made by Glico Nutrition Co., Ltd., can be used.

In the treatment composition for textile goods according to one embodiment of the invention, the content of the component (A) is not particularly limited, but may preferably be in the range of 0.01 to 10 mass %, more preferably 0.05 to 5 mass %, still more preferably 0.1 to 3 mass %, and most preferably 0.1 to 2 mass %. The component (A) contained in an amount of over 0.01 mass % can produce excellent deodorizing and odor preventing effects. When the component (A) is contained in an amount of more than 10 mass %, however, the deodorizing and odor preventing effects are not particularly further improved, and the usability may degrade in some cases.

Even if the highly branched cyclic dextrin is replaced by the general cyclodextrin having 6 to 8 glucose units linked, such as α-cyclodextrin (n=6), β-cyclodextrin (n=7), γ-cyclodextrin (n=8) or the like in the treatment composition for textile goods, it is impossible to obtain the same excellent deodorizing and odor preventing effects as those of the treatment composition for textile good according to the invention.

[Component (B)]

The component (B) contained in the treatment composition for textile goods according to one embodiment of the invention is at least one compound selected from the group consisting of: an amine compound having in the molecule thereof 1 to 3 hydrocarbon groups with 10 to 26 carbon atoms, which may be separated by an ester group or an amide group (hereinafter also referred to as a long-chain hydrocarbon group); a salt thereof; and a quaternary compound thereof.

The long-chain hydrocarbon group has 10 to 26 carbon atoms, preferably 17 to 26 carbon atoms, and more preferably 19 to 24 carbon atoms. When the number of carbon atoms exceeds 10, sufficiently soft feel can be imparted; and when the number of carbon atoms is 26 or less, the resultant handling properties are provided well.

The long-chain hydrocarbon group may be saturated or unsaturated. In the unsaturated long-chain hydrocarbon group, the double bond may be arranged anywhere. When there is one double bond, the double bond may preferably be located at the center of the long-chain hydrocarbon group, or distributed around the median.

The long-chain hydrocarbon group may be a chain hydrocarbon group or a hydrocarbon group having a ring in the structure thereof. The chain hydrocarbon group is preferred. The chain hydrocarbon group may be a straight-chain or branched hydrocarbon group. In particular, an alkyl group or an alkenyl group is preferable as the chain hydrocarbon group, and the former is more preferable.

The long-chain hydrocarbon group may be separated by an ester group (—COO—) or an amide group (—NHCO—). In other words, the long-chain hydrocarbon group may comprise in the carbon chain thereof at least one separating group selected from the group consisting of an ester group and an amide group, and the carbon chain may be separated by the separating group. The presence of the separating group is advantageous because the biodegradability becomes higher.

When the above-mentioned separating group is present, one long-chain hydrocarbon group may have one separating group or two or more separating groups. Namely, the long-chain hydrocarbon group may be separated at one location or two or more locations. When there are two or more separating groups, those separating groups may be the same or different.

When the separating group exists in the carbon chain, the number of carbon atoms contained in the separating group is included in the total number of carbon atoms of the long-chain hydrocarbon group.

Generally, the long-chain hydrocarbon group can be introduced by employing non-hydrogenated fatty acids derived from industrially available beef tallow and the fatty acids obtainable by hydrogenation or partial hydrogenation of the unsaturated moiety; or non-hydrogenated fatty acids or esters thereof derived from plants such as oil palm and the like and the fatty acids or esters thereof obtainable by hydrogenation or partial hydrogenation of the unsaturated moiety.

The amine compound used as the component (B) in the treatment composition for textile goods according to one embodiment of the invention may be preferably a secondary amine compound or a tertiary amine compound, more preferably a tertiary amine compound.

More specifically, the following compound represented by formula (B1) can be used as the amine compound of the component (B) in the treatment composition for textile goods according to one embodiment of the invention:

(B1)

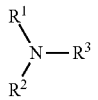

wherein $R^1$ to $R^3$ are each independently a hydrocarbon group having 10 to 26 carbon atoms, $—CH_2CH(Y)OCOR^4$ (in which Y is a hydrogen atom or $CH_3$ and $R^4$ is a hydrocarbon group having 7 to 21 carbon atoms), $—(CH_2)_nNHCOR^5$ (in which n is 2 or 3 and $R^5$ is a hydrocarbon group having 7 to 21 carbon atoms), a hydrogen atom, an alkyl group having 1 to 4 carbon atoms, $—CH_2CH(Y)OH$, or $—(CH_2)_nNH_2$, provided that at least one of $R^1$ to $R^3$ is a hydrocarbon group having 10 to 26 carbon atoms, $—CH_2CH(Y)OCOR^4$ or $—(CH_2)_nNHCOR^5$.

In the formula (B1), the hydrocarbon group with 10 to 26 carbon atoms, represented by $R^1$ to $R^3$, may preferably have 17 to 26 carbon atoms, and more preferably 19 to 24 carbon atoms. The above-mentioned hydrocarbon group may be saturated or unsaturated. The above-mentioned hydrocarbon group is preferably an alkyl group or an alkenyl group.

In the formula of $—CH_2CH(Y)OCOR^4$, Y is a hydrogen atom or $CH_3$, preferably a hydrogen atom.

$R^4$ is a hydrocarbon group having 7 to 21 carbon atoms, preferably 15 to 19 carbon atoms. When two or more $R^4$ are present in the compound represented by formula (B1), $R^4$ may be the same or different from each other.

The hydrocarbon group represented by $R^4$ is a residue (i.e., fatty acid residue) obtainable after removal of carboxyl group from a fatty acid ($R^4COOH$) having 8 to 22 carbon atoms. The source fatty acid ($R^4COOH$) may be a saturated or unsaturated fatty acid, and a straight-chain or branched fatty acid. In particular, a saturated or unsaturated straight-chain fatty acid is preferable. The ratio by mass of the saturated moiety to the unsaturated moiety of the source fatty acid may preferably be in the range of 90/10 to 0/100, and more preferably 80/20 to 0/100 for the purpose of imparting good water absorption properties to the softening-treated clothes.

When $R^4$ is a residue of unsaturated fatty acid, the residue is present in a cis-form or trans-form. The ratio by mass of the cis-form to the trans-form may preferably be in the range of 40/60 to 100/0, and more preferably 70/30 to 90/10.

Specific examples of the source fatty acid include stearic acid, palmitic acid, myristic acid, lauric acid, oleic acid, elaidic acid, linoleic acid, partially hydrogenated palm oil fatty acid (iodine value: 10 to 60), partially hydrogenated beef tallow fatty acid (iodine value: 10 to 60) and the like. In particular, it is preferable to use a fatty acid composition prepared by mixing predetermined amounts of two or more fatty acids selected from the group consisting of stearic acid, palmitic acid, myristic acid, oleic acid, elaidic acid and linoleic acid so as to meet the conditions (a) to (c) shown below.

(a) The ratio by mass of the saturated fatty acid to the unsaturated fatty acid is 90/10 to 0/100, preferably 80/20 to 0/100.

(b) The ratio by mass of the cis-form to the trans-form is in the range of 40/60 to 100/0, preferably 70/30 to 90/10.

(c) The fatty acid having 18 carbon atoms is contained in an amount of 60 mass % or more, preferably 80 mass % or more, the fatty acid having 20 carbon atoms is contained in an amount of less than 2 mass %, and the fatty acid having 21 to 22 carbon atoms is contained in an amount of less than 1 mass %.

In the formula of $—(CH_2)_nNHCOR^5$, n is 2 or 3, preferably 3.

$R^5$ is a hydrocarbon group having 7 to 21 carbon atoms, preferably 15 to 19 carbon atoms. When two or more $R^5$ are present in the compound represented by formula (B1), $R^5$ may be the same or different from each other.

Specifically, examples of $R^5$ are the same as those of $R^4$ shown above.

At least one of $R^1$ to $R^3$ is a long-chain hydrocarbon group (i.e., a hydrocarbon group having 10 to 26 carbon atoms, $—CH_2CH(Y)OCOR^4$ or $—(CH_2)_nNHCOR^5$). Preferably, two of $R^1$ to $R^3$ may be long-chain hydrocarbon groups.

When one or two of $R^1$ to $R^3$ are long-chain hydrocarbon groups, the rest two or one is a hydrogen group, an alkyl group having 1 to 4 carbon atoms, $—CH_2CH(Y)OH$, or $—(CH_2)_nNH_2$. In particular, an alkyl group having 1 to 4 carbon atoms, $—CH_2CH(Y)OH$, or $—(CH_2)_nNH_2$ are preferred. As the alkyl group having 1 to 4 carbon atoms, methyl group and ethyl group are preferable, and methyl group is more preferable. The group represented by Y in $—CH_2CH(Y)OH$ is the same as that in $—CH_2CH(Y)OCOR^4$. The definition of n in $—(CH_2)_nNH_2$ is the same as that in $—(CH_2)_nNHCOR^5$.

Preferable examples of the compound represented by the above-mentioned formula (B1) include the compounds of the following formulas (B1-1) to (B1-8):

(B1-1)

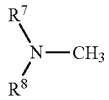

(B1-2)

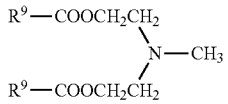

(B1-3)

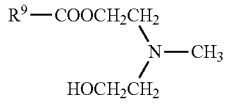

-continued (B1-4)

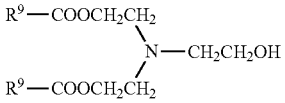

(B1-5)

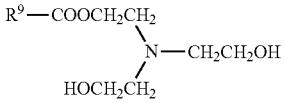

(B1-6)

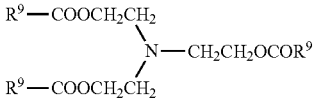

(B1-7)

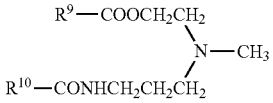

(B1-8)

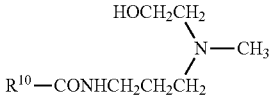

wherein $R^7$ and $R^8$ are each independently a hydrocarbon group having 10 to 26 carbon atoms, and $R^9$ and $R^{10}$ are each independently a hydrocarbon group having 7 to 21 carbon atoms.

The hydrocarbon group represented by $R^7$ and $R^8$ is the same as that having 10 to 26 carbon atoms shown in the description of $R^1$ to $R^3$.

The hydrocarbon group having 7 to 21 carbon atoms represented by $R^9$ and $R^{10}$ is the same as that having 7 to 21 carbon atoms shown in the description of $R^4$. When there are a plurality of $R^9$ in the formula, $R^9$ may be the same or different from each other.

The salt of the amine compound can be obtained by neutralizing the amine compound with an acid. The acid used for neutralization of the amine compound may be an organic or inorganic acid. For example, hydrochloric acid, sulfuric acid, methylsulfuric acid and the like can be used. The neutralization of the amine compound can be achieved by the known methods.

The quaternary compound of the amine compound can be obtained by reacting the amine compound with a quaternization agent. Examples of the quaternization agent used for quaternization of the amine compound include halogenated alkyl such as methyl chloride or the like, dialkylsulfuric acid such as dimethylsulfuric acid or the like. Upon the reaction of the amine compound with the quaternization agent, the alkyl group of the quaternization agent is introduced into a nitrogen atom of the amine compound, thereby forming a salt from the quaternary ammonium ion with the halogen ion or monoalkylsulfuric acid ion. The alkyl group to be introduced through the quaternization agent may be preferebly an alkyl group having 1 to 4 carbon atoms, more preferably a methyl group or an ethyl group, further preferably a methyl group. The amine compound can be quaternized by the known methods.

As the component (B), at least one selected from the group consisting of the compound represented by the above-mentioned formula (B1), the salt thereof and the quaternary compound thereof is preferable. In particular, at least one selected from the group consisting of the compounds of formulas (B1-1) to (B1-8) and the salts and quaternary compounds thereof are more preferable. More preferably, at least one selected from the group consisting of the compounds of formulas (B1-4) to (B1-6) and the salts and quaternary compounds thereof may be used.

The compound represented by formula (B1) and the salt thereof and the quaternary compound thereof may be commercially available products or may be prepared by the conventional methods.

For example, the compound represented by formula (B1-2) (hereinafter referred to as compound (B1-2)) and the compound represented by formula (B1-3) (hereinafter referred to as compound (B1-3)) can be synthesized by subjecting the above-mentioned fatty acid composition or the fatty acid methyl ester composition (prepared by replacing the fatty acid of the above-mentioned fatty acid composition with methyl ester of the corresponding fatty acid) and methyldiethanolamine to a condensation reaction. In this case, it is preferable to carry out the synthesis in such a fashion that the ratio by mass of the compound (B1-2) to the compound (B1-3) may be 99/1 to 50/50 from the viewpoint of improvement in the softening properties.

When the quaternary compound of the above compound is used, dimethylsulfuric acid is preferably used as the quaternization agent. In this case, it is preferable to carry out the synthesis in such a fashion that the ratio by mass of the quaternary compound of the compound (B1-2) to the quaternary compound of the compound (B1-3) may be 99/1 to 50/50 from the viewpoint of the softening properties.

The compound represented by formula (B1-4) (hereinafter referred to as compound (B1-4)), the compound represented by formula (B1-5) (hereinafter referred to as compound (B1-5)) and the compound represented by formula (B1-6) (hereinafter referred to as compound (B1-6)) can be synthesized by subjecting the above-mentioned fatty acid composition or the corresponding fatty acid methyl ester composition and triethanolamine to a condensation reaction. Based on the total mass of the compounds (B1-4), (B1-5) and (B1-6), the contents of the compounds (B1-4), (B1-5) and (B1-6) may preferably be 1 to 60 mass %, 5 to 98 mass %, and 0.1 to 40 mass %, respectively, and more preferably, 30 to 60 mass %, 10 to 55 mass %, and 5 to 35 mass %, respectively, from the viewpoint of the softening properties.

When the quaternary compound is used, dimethylsulfuric acid is more preferably used as the quaternization agent for fully advancing the quaternization reaction. The respective quaternary compounds of the compounds (B1-4), (B1-5) and (B1-6) may preferably be present in such amounts of 1 to 60 mass %, 5 to 98 mas %, and 0.1 to 40 mass %, respectively, and more preferably, 30 to 60 mass %, 10 to 55 mass %, and 5 to 35 mass %, respectively, from the viewpoint of the softening properties. When the compounds (B1-4), (B1-5) and (B1-6) are subjected to the quaternization reaction, non-quaternized ester amines remain after the quaternization reaction, in general. In this case, the ratio by mass of the quaternary compounds to the non-quaternized ester amines may preferably be within the range of 70/30 to 99/1.

The compound represented by formula (B1-7) (hereinafter referred to as compound (B1-7)) and the compound represented by formula (B1-8) (hereinafter referred to as compound (B1-8)) can be synthesized by a condensation reaction of the above-mentioned fatty acid composition and N-(2-hydroxyethyl)-N-methyl-1,3-propylenediamine that is synthesized from the adduct of N-methylethanolamine with acrylonitrile according to the known method described in J. Org. Chem., 26, 3409 (1960). In this case, it is preferable to carry out the synthesis in such a fashion that the ratio by mass of the compound (B1-7) to the compound (B1-8) may be 99/1 to 50/50. When the quaternary compound of the above compound is used, methyl chloride is preferably used as the quaternization agent. It is preferable to carry out the synthesis in such a fashion that the ratio by mass of the quaternary compound of the compound (B1-7) to the quaternary compound of the compound (B1-8) may be 99/1 to 50/50.

The content of the component (B) contained in the treatment composition for textile goods according to one embodiment of the invention is not particularly limited, but preferably in the range of 1 to 50 mass %, more preferably 5 to 35 mass %, still more preferably 5 to 30 mass %, further preferably 10 to 25 mass %, further more preferably 5 to 25 mass %, and most preferably 8 to 22 mass % when the treatment composition is a softener composition. Too more content of the component (B) will degrade the restorability of the frozen composition although the deodorizing and odor preventing effects will be enhanced. When the component (B) is contained in an amount of 1 mass % or more, the deodorizing and odor preventing effects are provided well. When the component (B) is contained in an amount of 5 mass % or more, the effect of imparting the soft feel to the textile goods becomes high. When the component (B) is contained in an amount of 30 mass % or less, the preservation stability is provided well.

When the treatment composition for textile goods is used as a spray type fabric treatment composition, the component (B) is preferably at least one compound selected from the group consisting of: an amine compound having in the molecule thereof two hydrocarbon groups with 10 to 14 carbon atoms, which may be separated by an ester group or an amide group; a salt thereof; and a quaternary compound thereof; and an amine compound having in the molecule thereof one hydrocarbon group with 10 to 18 carbon atoms, which may be separated by an ester group or an amide group; a salt thereof; and a quaternary compound thereof. In particular, an amine compound having in the molecule thereof two hydrocarbon groups with 10 to 14 carbon atoms, which may be separated by an ester group or an amide group, a salt thereof and a quaternary compound thereof are preferable. The content of the component (B) may preferably be in the range of 0.01 to 10 mass %, more preferably 0.03 to 8 mass %, and further preferably 0.05 to 5 mass %, based on the total mass of the spray type fabric treatment composition.

In the treatment composition for textile goods according to one embodiment of the invention, the ratio by mass of the component (A) to the component (B), i.e., (A)/(B) may preferably be 1/1000 to 1/1, more preferably 1/100 to 1/2. When the (A)/(B) ratio is within the above-mentioned range, the adsorption performance of the component (A) is improved, and the deodorizing and odor preventing effects can be more effectively obtained. When the ratio (A)/(B) is more than 1, the preservation stability at a high temperature may lower in some cases.

As previously stated, the fatty acids may be used in the preparation process of the component (B), and those fatty acids may be contained in the final product of the component (B).

When the treatment composition for textile goods according to one embodiment of the invention comprises the component (G) which will be described later in detail, at least one compound selected from the group consisting of an amine compound having in the molecule thereof one to three hydrocarbon groups, which may be separated by an ester group or an amide group, a salt thereof and a quaternary compound thereof is preferably used as the cationic surfactant; in particular, the cationic surfactant containing in the molecule thereof an ester group is preferably used.

The cationic surfactant containing the molecule thereof an ester group may include a cationic surfactant having in the molecule thereof one ester group (hereinafter referred to as component (B-i)), a cationic surfactant having in the molecule thereof two ester groups (hereinafter referred to as component (B-ii)), and a cationic surfactant having in the molecule thereof three ester groups (hereinafter referred to as component (B-iii)).

As the component (B-i), the following compound represented by formula (1) can be used.

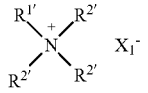

(1)

In the formula (1), $R^{1'}$ is a straight-chain or branched alkyl or alkenyl group containing one ester group, having 10 to 26 carbon atoms in total; $R^{2'}$ is a methyl group, an ethyl group, a hydroxyalkyl group having 1 to 4 carbon atoms or a straight-chain or branched alkyl or alkenyl group containing one amide group, having 10 to 26 carbon atoms in total; $X_1^-$ is an anion compatible with the treatment composition for textile goods. $R^{2'}$ may be the same or different from each other.

Preferably, $R^{1'}$ is an alkyl or alkenyl group containing one ester group, having 12 to 24 carbon atoms in total.

The hydroxyalkyl group as $R^{2'}$ may preferably be a hydroxyalkyl group having 2 to 3 carbon atoms. Specific examples of the group represented by $R^{2'}$ include a methyl group, a hydroxyethyl group, a hydroxypropyl group, a hydroxybutyl group and the like. In particular, a methyl group and a hydroxyethyl group are preferably employed. Specific examples of the $X_1^-$ include halogen atoms such as chlorine, bromine, iodine and the like, methylsulfuric acid, ethylsulfuric acid, methylcarbonic acid and the like. $X_1^-$ may preferably be methylsulfuric acid, ethylsulfuric acid or methylcarbonic acid, in particular, methylsulfuric acid is preferred. As the quaternary ammonium salt containing in the molecule thereof one ester group, represented by the above-mentioned formula (1), the quaternary ammonium salt of the following formula (2) is preferable.

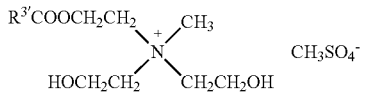

(2)

In the formula (2), $R^{3'}$ is a straight-chain or branched alkyl or alkenyl group having 7 to 23 carbon atoms.

$R^{3'}$ may preferably be a straight-chain or branched alkyl or alkenyl group having 9 to 21 carbon atoms. $R^{3'}$ is a residue of a fatty acid with 8 to 24 carbon atoms obtainable after removal of carboxyl group therefrom, and may be derived from any of saturated fatty acids or unsaturated fatty acids, or straight-chain fatty acids or branched fatty acids. When $R^{3'}$ is an unsaturated fatty acid residue, there exist both the cis-form and the trans-form. The ratio by mass of the cis-form to the trans-form may preferably be in the range of 40/60 to 100/0, more preferably 70/30 to 90/10, in order to have an appropriate viscosity of the resultant fabric treatment. Specific examples of the source fatty acid for $R^{3'}$ include stearic acid, palmitic acid, myristic acid, lauric acid, oleic acid, elaidic acid, partially hydrogenated palm oil fatty acid (iodine value: 10 to 60), partially hydrogenated beef tallow fatty acid (iodine value: 10 to 60) and the like.

In particular, it is preferable to use the predetermined amounts of any of stearic acid, palmitic acid, myristic acid, oleic acid and elaidic acid which are derived from plants in combination so that the ratio by mass of the saturated fatty acid moiety to the unsaturated fatty acid moiety may be 90/10 to 0/100, more preferably 80/20 to 0/100. It is particularly preferable to use a fatty acid composition adjusted so that the ratio by mass of the cis-form to the trans-form may be in the range of 70/30 to 90/10, and the fatty acid having 18 carbon atoms is contained in an amount of 60 mass % or more, the fatty acid having 20 carbon atoms is contained in an amount of 2 mass % or less, and the fatty acid having 22 carbon atoms is contained in an amount of 1 mass % or less.

As the component (B-ii), the following compound represented by formula (3) can be used.

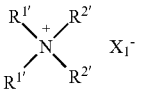

(3)

In the formula (3), $R^{1'}$, $R^{2'}$ and $X_1^-$ are the same as those previously defined in the above-mentioned formula (1). Each of $R^{1'}$ and $R^{2'}$ may be the same or different from each other.

Preferable definitions of $R^{1'}$, $R^{2'}$ and $X_1^-$ are also the same as those previously defined in the above-mentioned formula (1).

As the quaternary ammonium salt containing in the molecule thereof two ester groups represented by the above-mentioned formula (3), the quaternary ammonium salt of the following formula (4) is preferable.

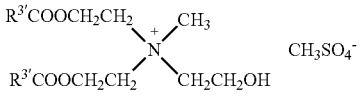

(4)

In the formula (4), $R^{3'}$ is the same as that previously defined in the above-mentioned formula (2), and the groups represented by $R^{3'}$ may be the same or different from each other.

Preferable definition of $R^{3'}$ is also the same as those previously defined in the above-mentioned formula (2).

As the component (B-iii), the following compound represented by formula (5) can be used.

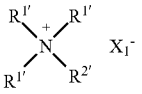

(5)

In the formula (5), $R^{1'}$ and $R^{2'}$ are the same as those previously defined in the above-mentioned formula (1). Each of $R^{1'}$ may be the same or different from each other.

Preferable definitions of $R^{1'}$, $R^{2'}$ and $X_1^-$ are also the same as those previously defined in the above-mentioned formula (1).

As the quaternary ammonium salt of formula (5) containing in the molecule thereof three ester groups, the quaternary ammonium salt of the following formula (6) is preferable.

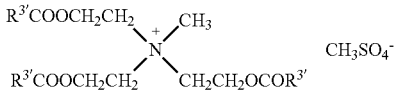

(6)

In the formula (6), $R^{3'}$ is the same as that previously defined in the above-mentioned formula (2), and the groups represented by $R^{3'}$ may be the same or different from each other.

Preferable definition of $R^{3'}$ is also the same as those previously defined in the above-mentioned formula (2).

The ratio by mass of the component (B-i) in the component (B), which is expressed by [component (B-i)]/[component (B-i)+component (B-ii)+component (B-iii)] is not particularly limited, but preferably 0.1 to 0.8, more preferably 0.3 to 0.8, and further preferably 0.5 to 0.8. Within the above-mentioned range, it is possible to obtain excellent properties of preventing the smell given off from textile goods left undried. The ratio by mass of the component (B-iii) in the component (B), which is expressed by [component (B-iii)]/[component (B-i)+component (B-ii)+component (B-iii)] is not particularly limited, but preferably 0 to 0.2, more preferably 0 to 0.15, and further preferably 0 to 0.1.

The content of the component (B) contained in the treatment composition for textile goods according to one embodiment of the invention is not particularly limited, but preferably in the range of 5 to 40 mass %, more preferably 10 to 35 mass %, and further preferably 20 to 30 mass % when the component (G) to be described later is added to the treatment composition. With the component (B) in an amount of 5 mass % or more, the softening effect can be exhibited well. When the content of the component (B) exceeds 40 mass %, the resultant viscosity tends to increase, which may impair the handling properties, in some cases.

The ratio by mass of the component (B) to the component (G) in the treatment composition for textile goods according to one embodiment of the invention, i.e., (B)/(G), is not particularly limited, but preferably 100 to 3,000, more preferably 150 to 1500, and further preferably 200 to 500. When the ratio of (B)/(G) is within the preferable range as mentioned above, the effects, especially the softening effect can be exhibited well even after the storage. When the ratio of (B)/(G) is less than 100, the preservation stability at a high temperature may deteriorate in some cases.

[Component (C)]

As the component (C), at least one or two or more compounds selected from the following compounds (C-1) to (C-3) are contained in the treatment composition for textile goods according to one embodiment of the invention.

<(C-1): Fatty Acid>

The component (C-1) contained in the treatment composition for textile goods according to one embodiment of the invention is a fatty acid represented by $R^aCOOH$, wherein $R^a$ is an alkyl or alkenyl group having 8 to 35 carbon atoms, preferably 13 to 35, more preferably 15 to 27, and further preferably 16 to 23 carbon atoms.

Specific examples of the component (C-1) contained in the treatment composition for textile goods according to one embodiment of the invention include myristic acid, palmitic acid, stearic acid, oleic acid, petroselinic acid, petroselaidic acid, elaidic acid, vacenic acid, arachidic acid, behenic acid, erucic acid, brassic acid, lignoceric acid, nervonic acid, cerotic acid, lauric acid, linoleic acid, or the mixtures thereof. In particular, palmitic acid, stearic acid, oleic acid, elaidic acid, arachidic acid or the mixtures thereof are preferable.

As previously mentioned, the component (B) may include fatty acids. The fatty acids of the component (B) also fall into the component (C-1) as far as the fatty acids can be represented by $R^aCOOH$.

The content of the component (C-1) contained in the treatment composition for textile goods according to one embodiment of the invention is not particularly limited, but preferably in the range of 0.001 to 10 mass %, more preferably 0.005 to 5 mass %, and further preferably 0.01 to 5 mass %

<(C-2): Silicone Compound>

The component (C-2) contained in the treatment composition for textile goods according to one embodiment of the invention is a silicone compound. The kind of silicone compound is not particularly limited and the silicone compound may appropriately be chosen according to the purpose of application. With respect to the molecular structure of the silicone compound, any of a straight-chain structure and a branched structure are usable, which may be cross-linked. Also, a modified silicone compound can be used, which may be modified with one kind of organic functional group, or two or more organic functional groups.

The silicone compound can be used in the form of oil or in the form of emulsion dispersed with any emulsifier.

Specific examples of the silicone compound include dimethyl silicone, polyether-modified silicone, methylphenyl silicone, alkyl-modified silicone, higher fatty acid-modified silicone, methylhydrogen silicone, fluorine-modified silicone, epoxy-modified silicone, carboxy-modified silicone, carbinol-modified silicone, amino-modified silicone and the like.

Among the above-mentioned silicone compounds, polyether-modified silicone, amino-modified silicone, dimethyl silicone and the like are preferable from the viewpoints of the versatility and the improvement in the deodorizing and odor preventing effects. In particular, polyether-modified silicone and amino-modified silicone are more preferable from the viewpoints of the resultant effects and the handling properties in the course of the preparation.

Specific examples of the polyether-modified silicone include copolymers of alkylsiloxane and polyoxyalkylene. In this case, the alkyl group of the alkylsiloxane may preferably have 1 to 3 carbon atoms; and the alkylene group of the polyoxyalkylene may preferably have 2 to 5 carbon atoms. As the polyether-modified silicone, copolymers of dimethylsiloxane and polyoxyalkylene (e.g., a random or block copolymer of polyoxyethylene, polyoxypropylene, ethylene oxide and propylene oxide) are preferred. The specific examples of the polyether-modified silicone include the compounds of formulas (I) and (II) as shown below.

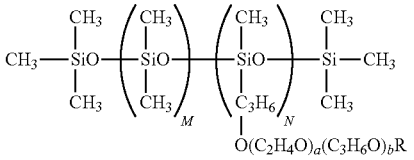

(I)

In the above-mentioned formula (I), M, N, a and b indicate the average polymerization degree, and R represents a hydrogen atom or an alkyl group. The average polymerization degree M may preferably be 10 to 10,000, more preferably 100 to 300; and N may preferably be 1 to 1,000, more preferably 1 to 100. Furthermore, M is preferably larger than N (M>N). The average polymerization degree a may preferably be 2 to 100, more preferably 2 to 50, and b may preferably be 0 to 50, more preferably 0 to 10. R may preferably represent a hydrogen atom or an alkyl group having 1 to 4 carbon atoms.

Generally, the polyether-modified silicone represented by the above-mentioned formula (I) can be prepared by subjecting an organohydrogenpolysiloxane having Si—H group and a polyoxyalkylene alkyl ether having a carbon-carbon double bond at the end such as polyoxyalkylene allyl ether to an addition reaction in the presence of platinum catalyst. Consequently, the obtained polyether-modified silicone may contain trace amounts of unreacted polyoxyalkylene alkyl ether and unreacted organohydrogenpolysiloxane having Si—H group in some cases. The Si—H group-containing organohydrogenpolysiloxane has such a high reactivity that the amount of the unreacted organohydrogenpolysiloxane may preferably be as low as 30 ppm or less (in terms of the amount of Si—H group).

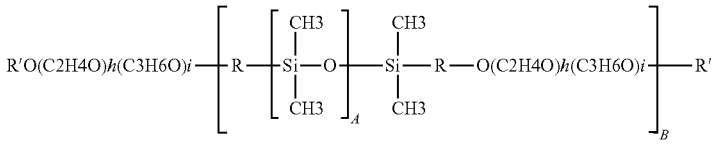

(II)

In the above-mentioned formula (II), A, B, h and i indicate the average polymerization degree, R represents an alkyl group, and R' represents a hydrogen atom or an alkyl group. The average polymerization degree A may preferably be 5 to 10,000, B may preferably be 2 to 10,000, h may preferably be 2 to 100, and i may preferably be 0 to 50. R may preferably represent an alkyl group having 1 to 5 carbon atoms. R' may preferably represent a hydrogen atom or an alkyl group having 1 to 4 carbon atoms.

The linear polysiloxane-polyoxyalkylene block copolymer represented by the above-mentioned formula (II) can be prepared by reacting a polyoxyalkylene compound having a reactive end group with a dihydrocarbylsiloxane having an end group that is reactive to the reactive end group of the above-mentioned polyoxyalkylene compound. The longer the polyoxyalkylene side chain and the higher the polymerization degree of the polysiloxane chain, the higher viscosity is imparted to the resultant polyether-modified silicone. Therefore, in the interest of good workability in the preparation and easy incorporation into an aqueous composition, it is recommended to prepare the polyether-modified silicone in the form of a premixture with a water-soluble organic solvent prior to the incorporation into the composition. Examples of the water-soluble organic solvent include ethanol, dipropylene glycol, butyl carbitol and the like.

Specific examples of the above-mentioned polyether-modified silicone include commercially available products, SH3772M, SH3775M, FZ-2166, FZ-2120, L-720, SH8700, L-7002, L-7001, SF8410, FZ-2164, FZ-2203 and FZ-2208 (made by Dow Corning Toray Co., Ltd.); KF352A, KF615A, X-22-6191, X-22-4515, KF-6012, KF-6004 and the like (made by Shin-Etsu Chemical Co., Ltd.); and TSF4440, TSF4441, TSF4445, TSF4450, TSF4446, TSF4452, TSF4460 and the like (made by Momentive Performance Materials Japan LLC.).

The amino-modified silicone is a silicone oil where amino group is introduced to the end of the dimethyl silicone skeleton or the side chain. In addition to the amino group, the skeleton may have other substituents such as hydroxyl group, alkyl group, phenyl group and the like. The amino-modified silicone may be in the form of oil and may be prepared into an amino-modified silicone emulsion using an emulsifier such as a nonionic surfactant or cationic surfactant. The preferable base oil of the amino-modified silicone oil or emulsion is represented by the following formula (III):

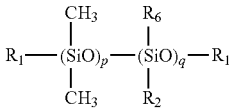

(III)

In the formula (III), $R_1$ and $R_6$, which may be the same or different from each other, are each a methyl group, a hydroxyl group or a hydrogen atom. $R_2$ is $—(CH_2)_n-A_1$ or $—(CH_2)_n—NHCO—(CH_2)_m-A_1$, in which $A_1$ represents $—N(R_3)(R_4)$ or $—N^+(R_3)(R_4)(R_5)$. $X^-$. $R_3$ to $R_5$, which may be the same or different from each other, are each a hydrogen atom, an alkyl group having 1 to 12 carbon atoms, a phenyl group, or $—(CH_2)_n—NH_2$. $X^-$ represents any one selected from the group consisting of fluorine ion, chlorine ion, bromine ion, iodine ion, methyl sulfate ion and ethyl sulfate ion. The numerals represented by m and n may be the same or different from each other, and represent an integer of 0 to 12. The numerals represented by p and q, which may be the same or different from each other, indicate the degree of polymerization of polysiloxane. The numeral of p may be 0 to 20,000, preferably 10 to 10,000; and the numeral of q may be 1 to 500, preferably 1 to 100.

When the amino-modified silicone in the form of oil is used for the treatment composition for textile goods according to one embodiment of the invention, the kinematic viscosity of the silicone oil may preferably be 50 to 20,000 $mm^2/s$ at 25° C., more preferably 100 to 10,000 $mm^2/s$ at 25° C. When the kinematic viscosity is within the above-mentioned range, the soft-feel imparting effect can be highly exhibited and the preparation can become easy, and also the handling properties of the resultant composition can be improved.

It is possible to use commercially available amino-modified silicone products, for example, amino-modified silicone oils such as SF-8417, BY16-892 and BY16-890 (made by Dow Corning Toray Co., Ltd.); KF-864, KF-860, KF-8004, KF-8002, KF-8005, KF-867, KF-861, KF-880 and KF-867S (made by Shin-Etsu Chemical Co., Ltd.), and the like.

Specific examples of the commercially available amino-modified silicone emulsion products include SM8904, BY22-079, FZ-4671 and FZ-4672 (made by Dow Corning Toray Co., Ltd.); Polon MF-14, Polon MF-29, Polon MF-14D, Polon MF-44, Polon MF-14EC and Polon MF-52 (made by Shin-Etsu Chemical Co., Ltd.); and WACKER FC201 and WACKER FC218 (made by Wacker Asahikasei Silicone Co., Ltd.).

The kinematic viscosity of the dimethyl silicone is not particularly limited, but preferably in the range of 1 to 100,000,000 $mm^2/s$, more preferably 10 to 10,000,000 $mm^2/s$, and further preferably 100 to 1,000,000 $mm^2/s$. The dimethyl silicone may be in the form of oil or emulsion.

The content of the component (C-2) contained in the treatment composition for textile goods according to one embodiment of the invention is not particularly limited, but preferably 0.001 to 10 mass %, more preferably 0.005 to 5 mass %, further preferably 0.01 to 5 mass %.

<(C-3): Alcohol>

The component (C-3) contained in the treatment composition for textile goods according to one embodiment of the invention is an aliphatic alcohol represented by $R^bOH$. $R^b$ represents an alkyl or alkenyl group having 8 to 35 carbon atoms, preferably 16 to 28 carbon atoms, more preferably 18 to 24 carbon atoms.

Examples of the component (C-3) contained in the treatment composition for textile goods according to one embodiment of the invention include myristyl alcohol, cetyl alcohol, 2-hexadecanol, stearyl alcohol, 2-octadecanol, elaidyl alcohol, petroselinyl alcohol, eleostearyl alcohol, arachidyl alcohol, 2-eicosanol, behenyl alcohol, erucyl alcohol, brassidyl alcohol and the like.

The content of the component (C-3) contained in the treatment composition for textile goods according to one embodiment of the invention is not particularly limited, but preferably 0.001 to 10 mass %, more preferably 0.005 to 5 mass %, further preferably 0.01 to 5 mass %.

In the treatment composition for textile goods according to one embodiment of the invention, an addition of the component (C) can contribute to high deodorizing and odor preventing effects. Regardless of whether the component (A) is used singly or together with the component (B), the adsorption properties of the component (A) onto the textile goods are not so good that sufficient deodorizing and odor preventing effects cannot be exhibited. In contrast, it is considered that the adsorption properties are increased by the addition of the component (C) when the components (A) and (B) are used together. It is considered that the reason for this may be that the component (C) is incorporated into the component (A) to improve the adsorption properties. The component (C) itself does not have the excellent deodorizing and odor preventing effects. Also, sufficient deodorizing and odor preventing effects cannot be obtained by simply using the component (A) and the component (C) together.

The content of the component (C) contained in the treatment composition for textile goods according to one embodiment of the invention is not particularly limited, but preferably 0.001 to 10 mass %, more preferably 0.005 to 9 mass %, further preferably 0.01 to 8 mass %. With the addition of the component (C) in an amount of 0.001 mass % or more, the improvement in the deodorizing and odor preventing effects can be well recognized. When the content of the component (C) exceeds 10 mass %, a certain kind of component (C) may act on the component (B) to unfavorably increase the viscosity, thereby the usability deteriorates, and causing separation of the resultant composition in some cases.

In the treatment composition for textile goods according to the invention, one kind of component (C) may be used or two or more kinds may be used in combination. As the component (C), use of the fatty acid (C-1) is preferable, and use of the fatty acid (C-1) in combination with the component (C-2) and/or the component (C-3) is more preferable.

The ratio by mass of the component (A) to the component (C), that is, (A)/(C) in the treatment composition for textile goods according to one embodiment of the invention may preferably be 1/100 to 100/1, more preferably 1/20 to 50/1. When the ratio is within the above-mentioned range, the deodorizing and odor preventing effects can be imparted to the composition more effectively.

[Component (D)]

The component (D) that can be contained in the treatment composition for textile goods according to one embodiment of the invention is a water-soluble solvent selected from the following groups (i) to (vi).

When the cationic surfactant and the highly branched cyclic dextrin are used together, the viscosity of the resultant composition may increase with time, which may make it difficult to charge the composition into a feeder of a washing machine. In some cases, the composition may not be uniformly attached to clothes when released into the tub of a washing machine during the rinsing operation. The addition of a water-soluble solvent selected from the following groups (i) to (vi) can maintain the proper viscosity of the composition and prevent the decrease of the usability over an extended period of time, and at the same time the deodorizing and odor preventing effects can last longer.

<(i) Alkanol>

The alkanols having 1 to 5 carbon atoms, such as ethanol, propanol, 1-butanol and the like are preferable.

<(ii) Polyol>

The polyols having 2 to 4 hydroxyl groups, such as ethylene glycol, propylene glycol, butylene glycol, hexylene glycol, glycerin and the like are preferable.

<(iii) Polyglycol>

As the polyglycol, diethylene glycol, triethylene glycol, tetraethylene glycol, polyethylene glycol having an average molecular weight of 200 to 11,500, dipropylene glycol, tripropylene glycol, polypropylene glycol having an average molecular weight of 200 to 1500 and the like are preferable.

<(iv) Alkylether>

Preferably used are those in which an alkyl group having 1 to 10 carbon atoms has been substituted for a hydrogen atom of a hydroxyl group of the above-mentioned polyols (ii) or polyglycols (iii), such as diethylene glycol monomethyl ether, diethylene glycol dimethyl ether, triethylene glycol monomethyl ether, diethylene glycol monoethyl ether, diethylene glycol diethyl ether, dipropylene glycol monomethyl ether, 1-methoxy-2-propanol, 1-ethoxy-2-propanol, 1-methylglyceryl ether, 2-methylglyceryl ether, 1,3-dimethylglyceryl ether, 1-ethylglyceryl ether, 1,3-diethylglyceryl ether, triethylglyceryl ether, 1-pentylglyceryl ether, 2-pentylglyceryl ether, 1-octylglyceryl ether, 2-ethylhexylglyceryl ether, diethylene glycol monobutyl ether, and the like.

<(v) Aromatic Ether>

As the aromatic ether, 2-phenoxyethanol, diethyleneglycol monophenyl ether, triethyleneglycol monophenyl ether, polyethylene glycol monophenyl ether having an average molecular weight of 200 to 1000, 2-benzyloxyethanol, diethyleneglycol monobenzyl ether and the like are preferable.

<(vi) Alkanolamine>

As the alkanolamine, 2-aminoethanol, N-methylethanolamine, N,N-dimethylethanolamine, N,N-diethylethanolamine, diethanolamine, N-methyldiethanolamine, N-butyldiethanolamine, triethanolamine, triisopropanolamine, a mixture of isopropanolamines (a mixture of mono-, di- and triisopropanolamines) and the like are preferable.

The content of the component (D) contained in the treatment composition for textile goods according to one embodiment of the invention is not particularly limited, but preferably 0.01 to 50 mass %, more preferably 0.1 to 30 mass %, and further preferably 1 to 20 mass %. When the content of the component (D) is too small, the resultant composition may become thicker and separated with time to lower the usability. On the other hand, when the component (D) is contained too much, the resultant composition may also become thicker and separated with time to lower the usability according to the kind of base material. In this case, cost performance is disadvantageous. As the component (D), (i) alkanol, (ii) polyol, (iii) polyglycol and (iv) Alkylether are Particularly Preferable.

The ratio by mass of the component (A) to the component (D), that is, (A)/(D) may preferably be 10/1 to 1/100, more preferably 5/1 to 1/50, further preferably 1/1 to 1/20. When the ratio is not within the above-mentioned range, the viscosity of the resultant composition may increase with time, which may make it difficult to charge the composition into a feeder of a washing machine. Also, the composition may not be uniformly attached to clothes when released into the tub of a washing machine during the rinsing operation, and therefore the deodorizing and odor preventing effects may not be improved in some cases.

It is preferable to appropriately use the combination of the components (D) from the viewpoints of long-lasting stable usability (e.g., easy discharge of the composition from a container, easy charge of the composition into a feeder of a washing machine), odor of the resultant composition, productivity of the composition and cost. In particular, it is preferable to use (i) alkanol in combination with (ii) polyol, (iii) polyglycol or (iv) alkylether.

[Component (E)]

The component (E) that can be contained in the treatment composition for textile goods according to one embodiment of the invention is a sugar compound having a degree of polymerization of 40 or less. The above-mentioned sugar compound can contribute to the improvement of stability when contained in addition to the highly branched cyclic dextrin.

Preferable examples of the sugar compound include monosaccharides, disaccharides, oligosaccharides, or sugar alcohols. To be more specific, there are glucose, fructose, galactose, arabinose, ribose, maltose, isomaltose, cellobiose, lactose, sucrose, trehalose, talose, maltotriose, isomaltotriose, oligosaccharides obtainable from natural polysaccharides through partial hydrolysis, and compounds (sugar derivatives) prepared by introducing substituents into the above-mentioned sugar compounds. In the monosaccharides and oligosaccharides, the number of repetition units of the sugar skeleton (i.e., the degree of polymerization) is preferably 1 to 40, more preferably 1 to 20, further preferably 1 to 5. In other words, monosaccharides and oligosaccharides with the degree of polymerization of more than 1 and 5 or less are preferred. Examples of the substituents that can be introduced include an alkyl group, an alkenyl group, an alkoxyl group, a hydroxyalkyl group, an amine group, a quaternary ammonium group, a carboxyl group and the like. In particular, an alkyl group, an alkenyl group and an alkoxyl group are preferred. An alkyl group, alkenyl group or alkoxyl group having 1 to 18 carbon atoms is preferable, and an alkyl group, alkenyl group or alkoxyl group having 1 to 12 carbon atoms is more preferable. Particularly, an alkyl group having 1 to 6 carbon atoms is still more preferable, and an alkyl group having 1 to 3 carbon atoms is most preferable. It is preferable that the component (E) comprise at least one selected from the group consisting of monosaccharides or oligosaccharides having a degree of polymerization of 1 to 5, and compounds derived from the monosaccharides or oligosaccharides having a degree of polymerization of 1 to 5, in which an alkyl group has been substituted for a hydrogen atom of at least one hydroxyl group. Examples of the sugar alcohol include erythritol, threitol, pentitol, hexitol, dulcitor, sorbitol, mannitol, volemitol, perseitol, xylitol, maltitol, lactitol and the like.

The content of the component (E) that can be contained in the treatment composition for textile goods according to one embodiment of the invention is not particularly limited, but preferably 0.01 to 10 mass %, more preferably 0.05 to 7 mass %, and further preferably 0.1 to 5 mass %.

[Component (F)]

The component (F) that can be contained in the treatment composition for textile goods according to one embodiment of the invention is an antioxidant. The antioxidant is conventionally found to provide the odor preventing effect. However, there was the problem where the addition of the antioxidant causes a change in color of the resultant treatment composition for textile goods. In contrast, when the antioxidant and the highly branched cyclic dextrin (component (A)) are used together, excellent deodorizing and odor preventing effects can be obtained, and at the same time it is possible to obtain the effect of inhibiting the color change of the composition caused by the presence of antioxidant. Any compounds generally known to have the antioxidant action can be used with no particular restriction.

For the component (F), one kind of antioxidant may be used alone, or two or more kinds of antioxidants may be used in combination. Specific examples of the component (F) include 3,5-di-t-butyl-4-hydroxytoluene (BHT), t-butyl-p-hydroxyanisole (BHA), p-methoxyphenol, β-naphthol, phenyl-α-naphthylamine, tetramethyldiaminodiphenylmethane, γ-oryzanol, vitamin E (α-tocopherol, β-tocopherol, γ-tocopherol, δ-tocopherol), vitamin C (L-ascorbic acid), trehalose, 2,2'-ethylidenebis(4,6-di-t-butylphenol), tris(tetramethylhydroxypiperidinol)•1/3citrate, bis(2,2,6,6-tetramethyl-4-piperidyl)sebacate, quercetin, 4,4'-bis(α,α-dimethylbenzyl) diphenylamine and the like. Among the above-mentioned compounds, at least one selected from the phenol type antioxidants is preferred, and at least one selected from the group consisting of 3,5-di-t-butyl-4-hydroxytoluene, t-butyl-p-hydroxyanisole, 2,2'-ethylidenebis(4,6-di-t-butylphenol), p-methoxyphenol and γ-oryzanol is preferable. More preferably used is 3,5-di-t-butyl-4-hydroxytoluene, p-methoxyphenol or 2,2'-ethylidenebis(4,6-di-t-butylphenol). Further preferably used is 3,5-di-t-butyl-4-hydroxytoluene.

The content of the component (F) in the treatment composition for textile goods according to one embodiment of the invention is not particularly limited, but preferably 0.001 to 5 mass %, more preferably 0.005 to 4 mass %, further preferably 0.01 to 3 mass %. With the content of less than 0.001 mass %, the odor preventing effect may not be satisfactory although the antioxidant is contained. When the content of the antioxidant exceeds 5 mass %, a particular improvement in the odor preventing effect will not be expected.

When the composition of the invention is a softener composition, the content of the component (F) may preferably be in the range of 0.01 to 5 mass %, more preferably 0.05 to 4 mass %, further preferably 0.1 to 3 mass %.

When the composition of the invention is a spray type fabric treatment composition, the content of the component (F) may preferably be in the range of 0.001 to 2 mass %, more preferably 0.005 to 1 mass %, further preferably 0.01 to 0.5 mass %.

In the treatment composition for textile goods according to one embodiment of the invention, when the component (F) and the component (A) are used together, the content of the component (A) is not particularly limited, but preferably 0.01 to 10 mass %, more preferably 0.03 to 5 mass %, further preferably 0.05 to 3 mass %. When the content of the component (A) is 0.01 mass % or more, the excellent effect of preventing yellow discoloration can be exhibited. When the content of the component (A) exceeds 10 mass %, the preservation stability at a high temperature may lower in some cases. In the case of the softener composition, the content of the component (A) may preferably be in the range of 0.1 to 10 mass %, more preferably 0.3 to 5 mass %, further preferably 0.5 to 3 mass %. In the case of the spray type fabric treatment composition, the content of the component (A) may preferably be in the range of 0.01 to 5 mass %, more preferably 0.03 to 3 mass %, further preferably 0.05 to 1 mass %.

The same excellent effect of preventing yellow discoloration as exhibited by the treatment composition for textile goods according to one embodiment of the invention cannot be obtained if the highly branched cyclic dextrin in the treatment composition for textile goods is replaced by a generally used cyclodextrin having 6 to 8 glucose units, such as α-cyclodextrin (n=6), β-cyclodextrin (n=7) or γ-cyclodextrin (n=8).

In the treatment composition for textile goods, the ratio by mass of the component (F) to the component (A), i.e., (F)/(A), is not particularly limited, but preferably 5 or less, more preferably 3 or less, particularly preferably 1 or less. When the ratio of the content of the component (F) to that of the component (A) is 5 or less, the excellent effect of preventing yellow discoloration can be exhibited.

[Component (G)]

The component (G) that can be contained in the treatment composition for textile goods according to one embodiment of the invention is a biguanide compound. It is found that when the highly branched cyclic dextrin which is classified as a physical deodorizing base material is contained in the treatment composition for textile goods, and the treatment composition is applied to textile goods such as clothes and towels, the excellent deodorizing and odor preventing effect can be obtained against a variety of offensive odors. However, such excellent performance may deteriorate after an elapse of storage time in some cases. In contrast, by using the highly branched cyclic dextrin as the component (A) and the biguanide compound in combination, the excellent deodorizing and odor preventing effects can last even after the storage. By further adding the cationic surfactant as the component (B), the odor preventing effect can be enhanced both at the initial stage and after the storage, and the excellent soft feel can be imparted to textile goods. When the composition comprises the component (G), it is preferable to use the cationic surfactant having in the molecule thereof one ester group in combination.

As the biguanide compound, the biguanide compound represented by the following formula (IV), chlorhexidine hydrochloride (1,1'-hexamethylenebis[5-(4-chlorophenyl)biguanide]dihedrochloride) and the like can be used.

$$—[R_8—NH—C(NH)—NH—C(NH)—NH]_n\text{-n.HY} \quad (IV)$$

(wherein $R_8$ is an alkylene group having 2 to 8 carbon atoms, preferably 4 to 8 carbon atoms, particularly preferably hexamethylene group; n is 2 to 14, preferably 10 to 14, more preferably 11 to 13, particularly preferably 12; and HY represents an organic or inorganic acid, preferably hydrochloric acid, gluconic acid or acetic acid, particularly preferably hydrochloric acid.)

With respect to the component (G) for use in the invention, polyhexamethylenebiguanide hydrochloride of formula (IV) wherein $R_8$ is a hexamethylene group, and n is 10 to 14, preferably 11 to 13 is most appropriate. The commercially available polyhexamethylenebiguanide antimicrobial agent can be used preferably, and a product of poly(hexamethylenebiguanide) hydrochloride (Proxel IB (registered trademark)) wherein $R_8$ is a hexamethylene group, n is 12 and HY is hydrochloric acid in the above-mentioned formula (IV) can be employed.

In the treatment composition for textile goods according to one embodiment of the invention, the biguanide compound provides the antimicrobial effect and therefore contributes to the improvement of the reducing performance of the smell given off from textile goods left undried. In addition, the biguanide compound also has the effect of preventing a cationic surfactant ingredient such as an ester cation or the like from hydrolyzing during the storage. Namely, the advantages provided by the cationic surfactant, such as the softening performance, the reducing performance of the smell given off from textile goods left undried, and the performance to preventing the adsorption properties of the cluster dextrin from lowering can be maintained effectively by the presence of the biguanide compound.

The content of the component (G) that can be contained in the treatment composition for textile goods according to one embodiment of the invention is not particularly limited, but preferably 0.01 to 5 mass %, more preferably 0.02 to 3 mass %, further preferably 0.05 to 2 mass %. When the content of the component (G) is 0.01 mass % or more, the excellent deodorizing and odor preventing effects can be exhibited even after the storage. When the content of the component (G) exceeds 5 mass %, the preservation stability at a high temperature may lower in some cases.

In the treatment composition for textile goods according to one embodiment of the invention, the ratio by mass of the component (A) to the component (G), i.e., (A)/(G), is not particularly limited, but preferably 5 to 300, more preferably 10 to 100, further preferably 20 to 50. When the ratio of (A)/(G) is within the preferable range as mentioned above, the excellent deodorizing and odor preventing effects can be exhibited even after the storage, particularly, against the odors resulting from cigarettes. When the ratio of (A)/(G) is less than 5, the preservation stability at a high temperature may lower in some cases.

[Other Optional Components]

The treatment composition for textile goods according to the invention may further comprise other optional components, when necessary, in addition to the above-mentioned components (A) to (G) as far as the effects of the invention are not lost.

As such optional components, any components conventionally known in the treatment composition for textile goods may be contained appropriately. For example, water, a nonionic surfactant, an amphoteric surfactant, an anionic surfactant, a dye and/or pigment, a preservative, a ultraviolet absorber, an antimicrobial agent, a perfume and the like may be contained in the composition.

<Water>

The treatment composition for textile goods according to the invention is preferably an aqueous composition, so that the composition may desirably contain water.

Any of tap water, deionized water, pure water, distilled water or the like can be used. In particular, deionized water is preferable.

Water may be preferably contained in the treatment composition for textile goods according to the invention in an amount of 50 mass % or more, more preferably 60 mass % or more. When the content of water exceeds the above-mentioned lower limit, the handling properties will be provided well.

<Water-Soluble Solvent>

As previously mentioned, the component (D) is a water-soluble solvent. Any other water-soluble solvents than the component (D) may be also contained in the treatment composition for textile goods according to the invention. For example, a solvent component selected from the water-soluble solvents represented by the following formula (X), which are not included in the component (D), may be contained.

$$R^{11}—O—(C_2H_4O)_y—(C_3H_6O)_z—H \quad (X)$$

wherein $R^{11}$ is an alkyl or alkenyl group having 1 to 6 carbon atoms, preferably 2 to 4 carbon atoms; y and z each represent the average addition molar number, and y is 1 to 10, preferably 2 to 5, and z is 0 to 5, preferably 0 to 2.

Examples of the water-soluble solvent represented by the formula (X) include butyl carbitol, and diethylene glycol monopropylene glycol monobutyl ether.

By way of example, the above-mentioned water-soluble solvent may be contained in the treatment composition for textile goods according to the invention in an amount of 30 mass % or less, 0.01 to 25 mass %, or 0.1 to 20 mass %.

<Nonionic Surfactant>

The nonionic surfactant is preferably used for the purpose of improving the preservation stability of the treatment composition for textile goods according to the invention, in particular, improving the dispersion stability of the oil-soluble components in an emulsion when the treatment composition for textile goods is prepared into the emulsion. Especially, from the viewpoint of the commercial value, a satisfactory level of restorability of the frozen composition can be easily ensured by addition of the nonionic surfactant.

The nonionic surfactant, for example, one derived from higher alcohols, higher amines or higher fatty acids may be used. To be more specific, there are polyoxyethylene alkyl ether where the alkyl or alkenyl group has 10 to 22 carbon atoms and the average addition molar number of ethylene oxide is 10 to 100; polyoxyalkylene alkyl ether where the alkyl or alkenyl group has 8 to 36 carbon atoms and the average addition molar number of alkylene oxide having 2 to 4 carbon atoms is 5 to 100; polyoxyethylene fatty acid alkyl ester where the alkyl group has 1 to 3 carbon atoms; polyoxyethylene alkylamine where the average addition molar number of ethylene oxide is 5 to 100, preferably 10 to 100; alkylpolyglucoside where the alkyl or alkenyl group has 8 to 18 carbon atoms; hydrogenated castor oil where the average addition molar number of ethylene oxide is 5 to 100, preferably 10 to 100; ester of polyol with fatty acid having a C8-24 alkyl or alkenyl group; ester of fatty acid having C8-24 alkyl or alkenyl group with polyoxyalkylene alkyl ether where 5 to 20 moles of alkylene oxide with 2 to 4 carbon atoms are added to polyol on an average, and the like. The above-mentioned alkyl or alkenyl group may be straight-chain or branched. In particular, preferably used are polyoxyethylene alkyl ether where the alkyl group has 10 to 18 carbon atoms and the average addition molar number of ethylene oxide is 20 to 80; polyoxyalkylene alkyl ether where the alkyl or alkenyl group has 8 to 36 carbon atoms, preferably 10 to 14 carbon atoms, and the average addition molar number of alkylene oxide having 2 to 4 carbon atoms is 5 to 100; hydrogenated castor oil where the average addition molar number of oxyethylene group is 5 to 100; ester of polyol with fatty acid having a C8-24 alkyl or alkenyl group; and ester of fatty acid having a C8-24 alkyl or alkenyl group with polyoxyalkylene alkyl ether where 5 to 20 moles of alkylene oxide with 2 to 4 carbon atoms are added to polyol on an average. More preferably used are polyoxyethylene alkyl ether where the alkyl group has 10 to 18 carbon atoms and the average addition molar number of ethylene oxide is 20 to 80, and polyoxyalkylene alkyl ether where the alkyl or alkenyl group has 8 to 36 carbon atoms, preferably 10 to 14 carbon atoms, and the average addition molar number alkylene oxide having 2 to 4 carbon atoms is 5 to 100, preferably 5 to 60.

The content of the nonionic surfactant in the treatment composition for textile goods according to the invention, which can be determined depending on the desired functions, for example, may preferably be in the range of 0.01 to 10 mass %, more preferably 0.1 to 8 mass %, further preferably 0.5 to 5 mass %. When the content of the nonionic surfactant is over the lower limit mentioned above, the dispersion stability of the oil-soluble components in the emulsion, and the restorability of the frozen emulsion can be further improved. When the content does not exceed the upper limit mentioned above, the increase of viscosity of the resultant treatment composition for textile goods can be inhibited, which can improve the usability of the composition.

When used as the softener composition, the treatment composition of the invention may preferably comprise the nonionic surfactant in an amount of 0.01 to 10 mass %, more preferably 0.1 to 8 mass %, further preferably 0.5 to 5 mass %.

When used as the spray type fabric treatment composition, the treatment composition of the invention further preferably comprise the nonionic surfactant in an amount of 0.01 to 5 mass %, more preferably 0.05 to 3 mass %, and most preferably 0.1 to 1 mass %.

When the treatment composition for textile goods according to one embodiment of the invention comprises the component (F), the ratio by mass of the component (F) to the nonionic surfactant, i.e., (F)/(nonionic surfactant), is not particularly limited, but preferably 2 or less, more preferably 1 or less, further preferably 0.5 or less. When the ratio of (F)/(nonionic surfactant) is 2 or less, the preservation stability can be further improved.

<Amphoteric Surfactant>

Examples of the amphoteric surfactant include alkyldimethylamine oxide having a C10-24 alkyl group; alkanoylamide propyldimethylamine oxide having a C10-24 alkanoyl group; N-alkyl-N,N-dimethyl-N-(2-hydroxy-3-sulfopropyl) ammonium betaine having a C10-24 alkyl group; N-alkyl-N,N-dimethyl-N-carboxymethylammonium betaine having a C10-24 alkyl group; N-alkanoylaminopropyl-N,N-dimethyl-N-(2-hydroxy-3-sulfopropyl)ammonium betaine having a C10-24 alkanoyl group; N-alkanoylaminopropyl-N,N-dimethyl-N-carboxymethylammonium betaine having a C10-24 alkanoyl group, and the like. The content of the amphoteric surfactant may preferably be 0.01 to 10 mass % based on the total mass of the treatment composition for textile goods.

When used as the softener composition, the treatment composition of the invention may preferably comprise the amphoteric surfactant in an amount of 0.01 to 10 mass %, more preferably 0.1 to 5 mass %, further preferably 0.3 to 3 mass %.

When used as the spray type fabric treatment composition, the treatment composition of the invention may preferably comprise the amphoteric surfactant in an amount of 0.01 to 5 mass %, more preferably 0.05 to 3 mass %, further preferably 0.1 to 1 mass %.

<Anionic Surfactant>

Examples of the anionic surfactant include alkylbenzene sulfonates having a

C10-15 alkyl group, alkylsulfates having a C10-24 alkyl group, α-olefin sulfonates having 10 to 24 carbon atoms, α-sulfo fatty acid methyl esters having a fatty acid with 10 to 24 carbon atoms, polyoxyethylene alkyl sulfates where the alkyl group has 10 to 24 carbon atoms and the average addition molar number of oxyethylene group is 1 to 6, and the like. In particular, alkylbenzene sulfonates having a C10-15 alkyl group is preferable. The content of the anionic surfactant may preferably be 0.01 to 25 mass % based on the total mass of the treatment composition for textile goods.

When used as the softener composition, the treatment composition of the invention may preferably comprise the anionic surfactant in an amount of 0.01 to 5 mass %, more preferably 0.05 to 4 mass %, further preferably 0.1 to 3 mass %.

When used as the spray type fabric treatment composition, the treatment composition of the invention may preferably comprise the anionic surfactant in an amount of 0.01 to 3 mass %, more preferably 0.03 to 2 mass %, further preferably 0.05 to 1 mass %.

<Cationic Surfactant>

The component (B) mentioned above is a cationic surfactant. Any other cationic surfactants than the component (B) may be also contained. For example, polyoxyethylene alkylmethyl ammonium salts where the average number of moles of the added oxyethylene group is 5 to 100, and the like can be used.

<Dye and/or Pigment>

The dye and/or pigment can be added for the purpose of upgrading the appearance of the treatment composition for textile goods according to the invention. Preferably, at least one kind of red, blue, yellow or violet water-soluble dye is selected from acid dyes, direct dyes, basic dyes, reactive dyes, mordant dyes and mordant acid dyes.

Specific examples of the dye that can be added are described, for example, in "Senryo Benran (Handbook of Dyes)" edited by The Society of Synthetic Organic Chemistry, Japan, issued in Jul. 20, 1970 by Maruzen Co., Ltd.

When consideration is given to the preservation stability of the treatment composition for textile goods according to the invention and the dyeing performance of fibers, it is preferable to use acid dyes, direct dyes and reactive dyes having the molecule thereof at least one functional group selected from the group consisting of a hydroxyl group, a sulfonic acid group, an amino group and an amide group. The content of the dye and/or pigment may preferably be 1 to 50 ppm, more preferably 1 to 30 ppm, based on the total mass of the composition.

The dyes as described in JP H6-123081 A, JP H6-123082 A, JP H7-18573 A, JP H8-27669 A, JP H9-250085 A, JP H10-77576 A, JP H11-43865 A, JP 2001-181972 A or JP 2001-348784 A can also be used in the treatment composition for textile goods according to the invention.

<Preservative>

The preservative can be contained in the treatment composition for textile goods according to the invention, chiefly for enhancing the rot-proof properties and antiseptic properties and preventing the composition from decaying during a long-term storage.

Examples of the preservative include isothiazolone type organic sulfur compounds, benzisothiazolone type organic sulfur compounds, benzoic acids, 2-bromo-2-nitro-1,3-propanediol and the like.

Specific examples of the isothiazolone type organic sulfur compounds include 5-chloro-2-methyl-4-isothiazolin-3-one, 2-n-butyl-3-isothiazolone, 2-benzyl-3-isothiazolone, 2-phenyl-3-isothiazolone, 2-methyl-4,5-dichloroisothiazolone, 5-chloro-2-methyl-3-isothiazolone, 2-methyl-4-isothiazolin-3-one and mixtures thereof. In particular, 5-chloro-2-methyl-4-isothiazolin-3-one and 2-methyl-4-isothiazolin-3-one are preferable. A mixture of 5-chloro-2-methyl-4-isothiazolin-3-one and 2-methyl-4-isothiazolin-3-one is more preferable, and the above-mentioned mixture containing about 77 mass % of the former and about 23 mass % of the latter is most preferable.

Specific examples of the benzisothiazolone type organic sulfur compounds include 1,2-benzisothiazolin-3-one, 2-methyl-4,5-trimethylene-4-isothiazolin-3-one, and the analogous compounds such as dithio-2,2-bis(benzmethylamide), and mixtures thereof. In particular, 1,2-benzisothiazolin-3-one is preferable.

Specific examples of the benzoic acids are benzoic acid or salts thereof, parahydroxybenzoic acid or salts thereof, methyl parahydroxybenzoate ethyl parahydroxybenzoate, propyl parahydroxybenzoate, butyl parahydroxybenzoate, benzyl parahydroxybenzoate and the like.

The content of the preservative in the treatment composition for textile goods according to the invention may preferably be in the range of 0.0001 to 1 mass % based on the total mass of the composition. When the content of the preservative is less than the lower limit mentioned above, the effect of the preservative cannot be easily obtained even though the preservative is added. When the content of the preservative exceeds the upper limit mentioned above, the preservation stability may be degraded in some cases.

<Ultraviolet Absorber>

The treatment composition for textile goods according to the invention may further comprise the ultraviolet absorber. The ultraviolet absorber is an agent capable of protecting the composition from ultraviolet rays by absorbing the ultraviolet rays and releasing infrared rays and visible rays converted from the ultraviolet rays.

Examples of the ultraviolet absorber include p-aminobenzoic acid and aminobenzoic acid derivatives such as ethyl p-aminobenzoate, glyceryl p-aminobenzoate, amyl p-dimethylaminobenzoate and the like; salicylic acid derivatives such as ethylene glycol salicylate, dipropylene glycol salicylate, octyl salicylate, myristyl salicylate and the like; cinnamic acid derivatives such as methyl diisopropylcinnamate, ethyl p-methoxycinnamate, isopropyl p-methoxycinnamate, 2-ethylhexyl p-methoxycinnamate, butyl p-methoxycinnamate and the like; benzophenone derivatives such as 2-hydroxy-4-methoxybenzophenone, 2-hydroxy-4-methoxybenzophenone-5-sulfonic acid, 2,2'-dihydroxy-4-methoxybenzophenone and the like; azole compounds such as urocanic acid, ethyl urocanate and the like; 4-t-butyl-4'-methoxybenzoylmethane and the like.

<Antimicrobial Agent>

Although the above-mentioned component (G) is the antimicrobial, any other antimicrobial agents than the component (G) may be also added. The conventionally known antimicrobial agents can appropriately be used. For example, diclosan, triclosan, zinc bis-(2-pyridylthio-1-oxide), 8-oxyquinoline, polylysine and the like can be used.

<Perfume>

Some perfumes may be added to the treatment composition for textile goods according to the invention to provide the composition with a fragrance. The perfume is not particularly limited, and the perfume ingredients that can be used are listed in a variety of references, e.g., Steffen Arctander, "Perfume and Flavor Chemicals" Vol. I and II, Allured Pub. Co. (1994); Genichi Indo, "Gosei-Koryo Kagaku to Shouhin Chishiki (Synthetic Fragrances Chemicals and Product knowledge)", The Chemical Daily Co., Ltd., (1996); Steffen Arctander, "Perfume and Flavor Materials of Natural Origin" Allured Pub. Co. (1994); "Kaori no Hyakka (Encyclopedia of Perfumes)", edited by Nippon Koryo Kyokai, Asakura Publishing Co., Ltd. (1989); "Perfumery Material Performance V.3.3", Boelens Aroma Chemical Information Service (1996); Danute Lajaujis Anonis, "Flower oils and Floral Compounds in Perfumery" Allured Pub. Co. (1993) and the like.

In addition to the above-mentioned compounds, the treatment composition for textile goods according to the invention may further comprise; an antioxidant and reducing agent for improving the stability of fragrance and color tone; emulsifier such as polystyrene emulsion, opacifying agent, various agents for improving the functions, e.g., shrinkage preventing agent, agent for preventing laundry wrinkles, shape retention agent, drape retention agent, agent for easy ironing, oxygen bleach inhibitor, brightener, whitening agent, fabric softening clay, antistatic agent, migration preventing agent such as polyvinyl pyrrolidone or the like, polymeric dispersant, dirt releasing agent, scum dispersant, fluorescent brightener such as 4,4-bis(2-sulfostyryl)biphenyl disodium (Tinopal CBS-X, made by Ciba Specialty Chemicals) or the like, dye fixative, anti-fade reagent such as 1,4-bis(3-aminopropyl)piperazine or the like, stain remover, enzyme for surface modification of textile fabrics, such as cellulase, amylase, protease, lipase, keratinase or the like, foam-inhibitor, agent capable of providing the improved silk texture and functions such as moisture absorption and release properties, such as silk protein powder, and the surface modified product thereof and the emulsion thereof, for example, K-50, K-30, K-10, A-705, S-702, L-710, FP-series (made by Idemitsu Chemicals), hydrolyzed silk liquid (Jomo Twisting Thread Co., Ltd.) and Silkgen G Soluble S (made by Ichimaru Pharcos Co., Ltd.), anti-contamination agent such as a nonionic polymeric compound composed of an alkylene terephthalate and/or alkylene isophthalate unit and a polyoxyalkylene unit, for example, FR627 (made by Goo Chemical Co., Ltd.), SRC-1 (made by Clariant Japan) and the like.

[pH]

The pH of the treatment composition for textile goods according to the invention is not particularly limited, but when the composition is used as the softener composition, the pH of the composition is preferably in the range from 1 to 6 at 25° C., more preferably 2 to 4 at 25° C. in order to prevent the component (B) from hydrolyzing along with an elapse of storage time. When used as the spray type fabric treatment composition, the composition may preferably be adjusted to pH 3 to 8 at 25° C., more preferably 4 to 7 at 25° C. in terms of less damage to the textile goods.

For the pH adjustment, it is possible to use a pH adjustor such as hydrochloric acid, sulfuric acid, phosphoric acid, alkylsulfuric acid, benzoic acid, p-toluenesulfonic acid, citric acid, malic acid, succinic acid, lactic acid, glycolic acid, hydroxyethanediphosphonic acid, phytic acid, short-chain amine compounds such as ethylenediaminetetraacetic acid, dimethylamine and the like, alkali metal hydroxides such as sodium hydroxide and the like, alkali metal carbonates, alkali metal silicates and the like.

[Viscosity]

When used as the softener composition, the treatment composition for textile goods according to the invention may preferably have a viscosity of less than 1000 mPa·s (as determined at 25° C. using a B type viscometer made by TOKIMEC). The above-mentioned measuring conditions are herein used. When consideration is given to the viscosity that tends to increase with time during the storage, the viscosity of the treatment composition immediately after the preparation may preferably be less than 800 mPa·s, more preferably less than 500 mPa·s. With the viscosity within the above-mentioned range, the usability of the composition, such as the handling properties of the composition to be set into the washing machine are provided well. When used as the spray type fabric treatment composition, the composition may preferably have a viscosity at 25° C. of 10 mPa·s or less, more preferably 5 mPa·s or less, in light of the handling properties. The viscosity can be adjusted by controlling the contents of the component (A) and water and the kinds and the contents of the surfactants.

An inorganic or organic water-soluble salt may be used for the purpose of controlling the viscosity of the treatment composition for textile goods according to the invention. For example, calcium chloride, magnesium chloride, sodium chloride, sodium p-toluenesulfonate, and the like may be used. In particular, calcium chloride and magnesium chloride are preferable. The water-soluble salt may be contained in the treatment composition for textile goods in an amount of about 0 to 1 mass % and added in any step of the preparation process of the treatment composition for textile goods.

[Preparation Method]

The treatment composition for textile goods according to the invention can be prepared by the known method, for example, in the same manner as in the preparation of the conventional liquid treatment compositions for textile goods comprising as the base material a cationic surfactant.

For example, an oil phase containing the component (B) and the component (C) is mixed with an aqueous phase containing the component (A) at a temperature equal to or higher than the melting point of the component (B) to prepare an emulsion. To the emulsion thus prepared, other components such as the component (G) and the like are then added if necessary, followed by mixing. Thus a desired composition can be prepared.

The oil phase may be prepared by mixing the component (B), the component (C) and other optional components as required at a temperature equal to or higher than the melting point of the component (B).

The aqueous phase may be prepared by mixing water, the component (A) and other optional components as required.

In the case where the component (C) is dispersed in an aqueous medium to form an emulsion, the oil phase comprising the component (B) and the aqueous phase comprising the component (A) are first mixed at a temperature equal to or higher than the melting point of the component (B) to prepare an emulsion, followed by addition of the component (C) and other optional components as required, thereby obtaining the final composition.

When the composition comprises the component (F), for example, the oil phase comprising the component (F) and surfactants including a nonionic surfactant and the like is mixed with the aqueous phase comprising the component (A) at a temperature equal to or higher than the melting point of the nonionic surfactant to prepare an emulsion, and then to the emulsion thus prepared, other components are added as required, thereby obtaining the final composition. The oil phase may be prepared by mixing the component (F), the nonionic surfactant and other optional components as required at a temperature equal to or higher than the melting point of the nonionic surfactant. The aqueous phase may be prepared by mixing water, the component (A) and other optional components as required. To enhance the effects, the oil phase comprising the surfactants such as the nonionic surfactant and the like and the aqueous phase may be mixed together at a temperature equal to or higher than the melting point of the nonionic surfactant to prepare an emulsion, and then to the emulsion thus prepared, a pre-mixture of an aqueous solution of the component (A) with a solution prepared by dissolving the component (F) in a water-soluble solvent may be added, and other components may also be added as required, thereby obtaining the final composition.

The spray type fabric treatment composition can be prepared in accordance with the conventional method. For example, the above-mentioned components may be mixed with water if necessary. When the component (F) is used, the preparation method may comprise mixing a solution prepared by dissolving the component (F) in a water-soluble solvent with an aqueous solution of the component (A) in advance, and then adding an aqueous solution of the surfactant and other optional components to the above-mentioned mixture for the purpose of enhancing the effects.

[Application and How to Use]

The application of the treatment composition for textile goods according to the invention is not limited, but the composition can be used for a detergent composition, bleach composition, softener composition, spray type fabric treatment composition and the like. In particular, the composition of the invention is preferably applied as the softener composition or spray type fabric treatment composition, and in such cases, desirable soft feel and fragrance can be given to both of natural textile fabrics such as cotton and the like and synthetic textile fabrics such as polyester and the like.

The way of how to treat the textile goods such as clothes and the like with the treatment composition for textile goods according to the invention is not particularly limited. The treatment composition of the invention can be used to treat the textile goods in the same manner as the conventionally known detergents, finishers (i.e., softeners, starching agents and the like), spray type fabric treatments and the like.

When used as the softener composition, the treatment composition for textile goods according to the invention may be used in any way with no restriction. By way of example, the composition of the invention may be added to rinsing water in a washing machine and dissolved therein for treatment of textile goods during the rinsing cycle; or the composition of the invention may be dissolved in water held in a container such as a washtub and clothes may be immersed therein. In such cases, the composition is diluted to appropriate concentrations. The bath ratio (i.e., the ratio by mass of the treatment liquid to the textile goods) may preferably be 3 to 100 times, and particularly 5 to 50 times. To be more specific, for the softening treatment, the composition is preferably used in such a way that the concentration of the component (A) in the total amount of water may preferably be 0.01 to 100 ppm, more preferably 0.1 to 50 ppm; and the concentration of the component (B) in the total amount of water may preferably be 0.01 to 1000 ppm, more preferably 0.1 to 300 ppm. Regardless of whether the rinsing operation may be conducted once or two times or more, the composition of the invention can be used in a similar way to exhibit the deodorizing and odor preventing effects.

When used as the spray type fabric treatment composition, the treatment composition for textile goods according to the invention may be used in any way with no restriction. For example, the treatment composition may be charged into a trigger-type spray bottle or a dispenser type of pump and spray bottle to directly spray the composition upon textile goods. When necessary, the textile goods may be dried after spraying of the composition. The textile goods are not particularly limited, and include clothes, curtains, sofas, carpets, towels, handkerchiefs, sheets, pillow cases and the like. The amount of the treatment composition to be applied to the textile goods may preferably be in the range of 0.5 to 10 g, more preferably 1 to 5 g, per 100 g of the textile goods.

Preferably, the spray type fabric treatment may be placed into a trigger-type spray bottle (hereinafter simply referred to as a trigger bottle). The trigger bottle is not particularly limited. It is possible to use the same trigger bottles as generally used for holding the fabric treatment products therein to impart good fragrance and a deodorizing effect or the like to textile goods including clothes and the like. In light of excellent sprayability, satisfactory spray pattern, and the absence of afterdraw, pressure-actuated trigger bottles are preferable. The amount of the composition to be discharged by one-time spraying operation is preferably 0.2 to 0.6 g so as not to leave a stain on textile goods after spraying the treatment, and make the operator's hand get excessively tired for obtaining the desired effects.

EXAMPLES

The invention will now be explained more specifically by referring to the following examples, but the invention is not limited to them. In the following examples, the amount of each component is expressed by mass % (in terms of pure content unless otherwise specified).

Test Example 1

[Component (A)]

A-1: Cluster Dextrin (registered trademark, made by Glico Nutrition Co., Ltd.)

The Cluster Dextrin (registered trademark) is chiefly composed of a dextrin with a molecular weight of about 30,000 to about 1,000,000 which has in the molecule thereof one cyclic structure to which a number of glucan chains are bonded, with a weight average degree of polymerization of about 2,500. The cyclic structure portion has about 16 to about 100 glucose units, with lots of noncyclic branched glucan chains being bonded to the cyclic structure.

A-2 (Comparative Example): α-cyclodextrin

[Component (B)]

B-1: Cationic surfactant (the compound described in Example 4 of JP 2003-12471 A)

The surfactant B-1 is considered to comprise a fatty acid derived from the preparation process.

B-2: Cationic surfactant (ARQUAD 2HT, made by Lion Akzo Co., Ltd.)

The surfactant B-2 comprises as the chief ingredient distearyldimethylammonium chloride, and does not comprise any fatty acid.

[Component (C)]

C-1-1: Oleic acid (made by Tokyo Chemical Industry Co., Ltd.)

C-1-2: Stearic acid (made by Tokyo Chemical Industry Co., Ltd.)

C-2-1: Polyether-modified silicone (the compound B-1 described in Example of JP 2010-255170 A)

C-2-2: Amino-modified silicone (SM8904, made by Dow Corning Toray Co., Ltd.)

C-2-3: Dimethylsilicone (BY22-007, made by Dow Corning Toray Co., Ltd.)

C-3-1: Behenyl alcohol (made by Tokyo Chemical Industry Co., Ltd.)

[Optional Components]

(Component 1) Nonionic surfactant: 60 mole ethylene oxide adduct of primary isotridecyl alcohol (in which ethylene oxide is added to Lutensol T03 made by BASF Japan Ltd.)

This nonionic surfactant, which is abbreviated to "Nonion" in Tables 2 to 4, was used at a concentration of 2% in the resultant treatment composition for textile goods (softener composition).

(Component 2) Calcium chloride (Calcium chloride (granular), made by Tokuyama Corporation)

The calcium chloride was used at a concentration of 0.8% in the resultant treatment composition for textile goods (softener composition).

(Component 3) Perfume ingredients

A perfume composition A having a formulation as shown in the following Table 1 was used at a concentration of 0.8% in the resultant treatment composition for textile goods (softener composition).

TABLE 1

| Perfume Ingredients | Perfume Composition A |
|---|---|
| Ambroxan | 2 |
| Iso E super | 2 |
| γ-undecalactone | 2 |
| Ethylvanillin | 2 |
| Eugenol | 1 |
| Orange oil | 2 |
| Cashmeran | 3 |
| Galaxolide (25% dipropylene glycol solution) | 3 |
| Coumarine | 1 |
| Geraniol | 2 |
| Citral | 1 |
| Citronellol | 1 |
| Dihydromyrcenol | 3 |
| Dibutylhydroxytoluene | 2 |
| Dipropylene glycol | 2 |
| Dimethylbenzyl carbinyl acetate | 2 |
| Geranium oil | 2 |
| Terpineol | 2 |
| Phenylethyl alcohol | 3 |
| Damascenone | 1 |
| 1-decanal (10% dipropylene glycol solution) | 1 |
| Tetrahydrolinalol | 4 |
| Tranide | 3 |
| Tripral | 1 |
| Phenylethyl alcohol | 2 |
| Hexyl cinnamic aldehyde | 4 |
| β-ionone | 3 |
| Hedion | 5 |
| Beltfix | 5 |
| Benzyl salicylate | 2 |
| Eucalyptus oil | 1 |
| Methyl ionone | 2 |
| Lime oil | 4 |
| Linalyl acetate | 1 |
| Linalol | 1 |
| Limonene | 3 |
| Lyral | 6 |
| Lilial | 7 |
| Lemon oil | 4 |
| Rose base | 2 |
| Total | 100 |

The unit of the numerical values shown in table 1 is mass %.

[Preparation Method of Treatment Composition for Textile Goods (Softener Composition) and Base Composition]

The predetermined amounts of the components were weighed in accordance with the formulations as shown in the following Tables 2 to 4, and liquid treatment compositions for textile goods (softener compositions) and a base composition were prepared according to the following procedures, using a glass vessel with an inner diameter of 100 mm and a height of 150 mm and an agitator (Agitor Model SJ, made by Shimadzu Corporation). The component (B), the components (C-1), (C-2) and (C-3-1), and optional components (1) and (3) were mixed and then stirred to obtain an oil phase mixture. The component (A) was dissolved in deionized water (used as the balance of each composition) to obtain an aqueous phase mixture. The mass of the above-mentioned deionized water corresponds to the difference obtained by subtracting the total amounts of the oil phase mixture, the component (A), the component (C-2-2), the component (C-2-3) from 980 g. The oil phase mixture heated to a temperature equal to or higher than the melting point of the component (B) was placed into the glass vessel. Then, the aqueous phase mixture heated to a temperature equal to or higher than the melting point of the component (B) was added to the oil phase mixture in two divided portions with stirring, followed by further stirring. The ratio by mass of the divided portions of the aqueous phase mixture was 30:70. The stirring was conducted at 1,000 rpm for three minutes after addition of the first portion of the aqueous phase mixture, and for two minutes after addition of the second portion of the aqueous phase mixture. Thereafter, the components (C-2-2) and (C-2-3) and the optional component (2) were added to the mixture, and as necessary, hydrochloric acid (1 mol/L, reagent made by Kanto Chemical Co., Inc.) or sodium hydroxide (1 mol/L, reagent made by Kanto Chemical Co., Inc.) was appropriately added to adjust the pH to 2.5. Finally, deionized water was added until the total mass reached 1,000 g, thereby obtaining desired treatment compositions for textile goods (softener compositions of Examples 1 to 26 and Comparative Examples 1 to 5) and a base composition.

[Evaluation of Deodorizing and Odor Preventing Effect Against Smell Resulting from Sweat]

1. Pretreatment of Cloth Used for Evaluation

Commercially available cotton undershirts (BVD brand undershirts) were subjected to a pretreatment process three times in a twin-tub washing machine (Model CW-C30A1-H, made by Mitsubishi Electric Corporation) using a commercially available laundry detergent TOP Platinum Clear (made by Lion Corporation). (The conditions of the pretreatment process are as follows: a standard use level of the laundry detergent; a bath ratio of 30 times; tap water of 45° C.; and the washing operation for 10 minutes followed by the water pouring and rinsing operation for 10 minutes repeated two times.)

2. Treatment in the Rinsing Operation in the Washing Cycle

The cotton undershirt thus pretreated was cut into halves. One half (A) of the undershirt was treated with a composition according to any of Examples or Comparative Examples, and the other half (B) was treated with the base composition. In this case, the treatment was conducted in such a manner that in a twin-tub washing machine (Model CW-C30A1-H, made by Mitsubishi Electric Corporation) the half pieces of undershirts were washed in a standard mode for 10 minutes at a bath ratio of 20 times using the commercially available laundry detergent TOP Platinum Clear (made by Lion Corporation) at a standard use level and tap water of 25° C., and then subjected to the first rinsing operation for 3 minutes, and the second rinsing operation for 3 minutes where the pieces of the undershirts were treated with 5 mL of each treatment composition (with respect to 1 kg of the undershirts) in tap water of 25° C. at a bath ratio of 20 times. One minute's spinning operation was provided after the washing operation and each rinsing operation. Then, the pieces of undershirts were dried for 20 hours under thermostatically and humidistatically controlled conditions of 20° C. and 45% RH. At last, the half (A) treated with the composition according to any of Examples or Comparative Examples and the half (B) treated with the base composition were sewed together to prepare a cloth for evaluating the deodorizing and odor preventing effects.

3. Evaluation of Deodorizing and Odor Preventing Effects

Five men in their twenties and thirties wore the thus treated undershirts for one day in August. Then, the smell of the undershirts was evaluated in a panel of four professional members by the organoleptic pairwise comparison according to the evaluation criteria shown below, and the average score was calculated. The results are shown in Tables 2 to 4.

<Evaluation Criteria>

+2: Distinctly better than the control

+1: Somewhat better than the control

0: Almost the same as the control

−1: The control was somewhat better.

−2: The control was distinctly better.

The control was the treatment with the base composition.

<Criterion of Judgment>

The score of 1 or more was regarded as acceptable.

[Evaluation of Deodorizing and Odor Preventing Effect Against Offensive Smell Resulting from Indoor Drying]

1. Pretreatment of Cloth Used for Evaluation

Commercially available cotton towels were subjected to a pretreatment process three times in a twin-tub washing machine (Model CW-C30A1-H, made by Mitsubishi Electric Corporation) using a commercially available laundry detergent TOP Platinum Clear (made by Lion Corporation). (The conditions of the pretreatment process are as follows: a standard use level of the laundry detergent; a bath ratio of 30 times; tap water of 45° C.; and the washing operation for 10 minutes followed by the water pouring and rinsing operation for 10 minutes repeated two times.)

2. Treatment in the Rinsing Operation in the Washing Cycle

Men in their thirties used the towels thus pretreated for one day. The treatment was then conducted in such a manner that in a twin-tub washing machine (Model CW-C30A1-H, made by Mitsubishi Electric Corporation) the towels were washed in a standard mode for 10 minutes at a bath ratio of 20 times using the commercially available laundry detergent TOP Platinum Clear (made by Lion Corporation) at a standard use level and tap water of 25° C., and then subjected to the first rinsing operation for 3 minutes, and the second rinsing operation for 3 minutes where the towels were treated with 5 mL of each treatment composition (prepared in Examples and Comparative Examples and a base composition) with respect to 1 kg of the cotton towels, in tap water of 25° C. at a bath ratio of 20 times. One minute's spinning operation was provided after the washing operation and each rinsing operation. Then, the wet towels were left at 30° C. and 100% RH for 6 hours.

3. Evaluation of Deodorizing and Odor Preventing Effects

Then, the smell of the towels left as mentioned above was evaluated in a panel of ten professional members by the organoleptic pairwise comparison according to the evaluation criteria shown below, and the average score was calculated. The results are shown in Tables 2 to 4.

<Evaluation Criteria>

+2: Distinctly better than the control

+1: Somewhat better than the control

0: Almost the same as the control

−1: The control was somewhat better.

−2: The control was distinctly better.

The control was the treatment with the base composition

<Criterion of Judgment>

The score of 1 or more was regarded as acceptable.

TABLE 2

Treatment compositions for textile goods (softener compositions) according to Examples and the evaluation results (The unit of the numerical values of the composition is mass %.)

| | Examples | | | | | | | | | |
|---|---|---|---|---|---|---|---|---|---|---|
| | 1 | 2 | 3 | 4 | 5 | 6 | 7 | 8 | 9 | 10 |
| A-1 | 1 | 1 | 1 | 5 | 0.05 | 1 | 1 | 1 | 1 | 1 |
| A-2 | | | | | | | | | | |
| B-1 | 22 | 22 | 22 | 22 | 22 | 1 | 35 | 22 | 22 | 22 |
| B-2 | | | | | | | | | | |

TABLE 2-continued

| | | | | | | | | | | |
|---|---|---|---|---|---|---|---|---|---|---|
| Moiety of component B corresponding to C-1 | 0.2 | 0.2 | 0.2 | 0.2 | 0.2 | 0.0 | 0.3 | 0.2 | 0.2 | 0.2 |
| C-1-1 | | 0.2 | | 0.2 | 0.2 | 0.2 | 0.2 | 4 | 0.2 | 0.2 |
| C-1-2 | | | 0.2 | | | | | | | |
| C-2-1 | | | | | | | | | 2 | |
| C-2-2 | | | | | | | | | | 2 |
| C-2-3 | | | | | | | | | | |
| C-3-1 | | | | | | | | | | |
| Nonion | 2 | 2 | 2 | 2 | 2 | 2 | 2 | 2 | 2 | 2 |
| Calcium chloride | 0.8 | 0.8 | 0.8 | 0.8 | 0.8 | 0.8 | 0.8 | 0.8 | 0.8 | 0.8 |
| Perfume composition | 0.8 | 0.8 | 0.8 | 0.8 | 0.8 | 0.8 | 0.8 | 0.8 | 0.8 | 0.8 |
| Deionized water | Balance | | | | | | | | | |
| Total amounts of component (C) | 0.2 | 0.4 | 0.4 | 0.4 | 0.4 | 0.2 | 0.5 | 4.2 | 2.4 | 2.4 |
| A/B | 0.05 | 0.05 | 0.05 | 0.23 | 0.002 | 1.00 | 0.03 | 0.05 | 0.05 | 0.05 |
| A/C | 5 | 2.5 | 2.5 | 12.5 | 0.125 | 5 | 2 | 0.238 | 0.417 | 0.417 |
| Smell from sweat | 1.25 | 1.30 | 1.40 | 1.85 | 1.05 | 1.15 | 1.65 | 1.90 | 1.80 | 1.95 |
| Smell from indoor drying | 1.20 | 1.20 | 1.20 | 1.40 | 1.00 | 1.00 | 1.30 | 1.40 | 1.50 | 1.50 |

Treatment compositions for textile goods (softener compositions) according to Examples and the evaluation results (The unit of the numerical values of the composition is mass %.)

| | Examples | | | | | | | | |
|---|---|---|---|---|---|---|---|---|---|
| | 11 | 12 | 13 | 14 | 15 | 16 | 17 | 18 | 19 |
| A-1 | 1 | 1 | 1 | 1 | 1 | 1 | 1 | 1 | 1 |
| A-2 | | | | | | | | | |
| B-1 | 22 | 22 | 22 | | | | 22 | 22 | 22 |
| B-2 | | | | 22 | 22 | 22 | | | |
| Moiety of component B corresponding to C-1 | 0.2 | 0.2 | 0.2 | 0.0 | 0.0 | 0.0 | 0.2 | 0.2 | 0.2 |
| C-1-1 | 0.2 | 0.2 | 0.1 | 0.2 | | | | | |
| C-1-2 | | | 0.1 | | | | | | |
| C-2-1 | | | | | | | | | |
| C-2-2 | | | | | 0.2 | | 2 | 4 | 8 |
| C-2-3 | 2 | | | | | | | | |
| C-3-1 | | 2 | | | | 0.2 | | | |
| Nonion | 2 | 2 | 2 | 2 | 2 | 2 | 2 | 2 | 2 |
| Calcium chloride | 0.8 | 0.8 | 0.8 | 0.8 | 0.8 | 0.8 | 0.8 | 0.8 | 0.8 |
| Perfume composition | 0.8 | 0.8 | 0.8 | 0.8 | 0.8 | 0.8 | 0.8 | 0.8 | 0.8 |
| Deionized water | | | | | | | | | |
| Total amounts of component (C) | 2.4 | 2.4 | 0.4 | 0.2 | 0.2 | 0.2 | 2.2 | 4.2 | 8.2 |
| A/B | 0.05 | 0.05 | 0.05 | 0.05 | 0.05 | 0.05 | 0.05 | 0.05 | 0.05 |
| A/C | 0.417 | 0.417 | 2.5 | 5 | 5 | 5 | 0.5 | 0.238 | 0.123 |
| Smell from sweat | 1.70 | 1.75 | 1.45 | 1.25 | 1.20 | 1.15 | 1.90 | 1.95 | 1.95 |
| Smell from indoor drying | 1.40 | 1.30 | 1.20 | 1.20 | 1.20 | 1.20 | 1.40 | 1.60 | 1.60 |

TABLE 3

Treatment compositions for textile goods (softener compositions) according to Examples and the evaluation results (The unit of the numerical values of the composition is mass %.)

| | Examples | | | | | | |
|---|---|---|---|---|---|---|---|
| | 20 | 21 | 22 | 23 | 24 | 25 | 26 |
| A-1 | 1 | 1 | 1 | 1 | 1 | 1 | 2 |
| A-2 | | | | | | | |
| B-1 | 15 | 15 | 15 | 15 | 15 | 10 | 15 |
| B-2 | | | | | | | |
| Moiety of component B corresponding to C-1 | 0.2 | 0.2 | 0.2 | 0.2 | 0.2 | 0.1 | 0.2 |
| C-1-1 | 0.2 | | 4 | | 0.2 | 0.2 | 0.2 |
| C-1-2 | | 0.2 | | 4 | | | |

TABLE 3-continued

Treatment compositions for textile goods (softener compositions) according to Examples and the evaluation results (The unit of the numerical values of the composition is mass %.)

| | Examples | | | | | | |
|---|---|---|---|---|---|---|---|
| | 20 | 21 | 22 | 23 | 24 | 25 | 26 |
| C-2-1 | | | | | 2 | | |
| C-2-2 | | | | | | | |
| C-2-3 | | | | | | | |
| C-3-1 | | | | | | | |
| Nonion | 2 | 2 | 2 | 2 | 2 | 2 | 2 |
| Calcium chloride | 0.8 | 0.8 | 0.8 | 0.8 | 0.8 | 0.8 | 0.8 |
| Perfume composition | 0.8 | 0.8 | 0.8 | 0.8 | 0.8 | 0.8 | 0.8 |
| Deionized water | Balance | | | | | | |
| Total of component C | 0.4 | 0.4 | 4.2 | 4.2 | 2.4 | 0.3 | 0.4 |
| A/B | 0.07 | 0.07 | 0.07 | 0.07 | 0.07 | 0.10 | 0.13 |
| A/C | 2.50 | 2.50 | 0.24 | 0.24 | 0.42 | 3.33 | 5.00 |
| Smell from sweat | 1.25 | 1.35 | 1.6 | 1.7 | 1.5 | 1.2 | 1.65 |
| Smell from indoor drying | 1.2 | 1.2 | 1.3 | 1.3 | 1.3 | 1.15 | 1.3 |

TABLE 4

Treatment compositions for textile goods (softener compositions) according to Comparative Examples and a base composition, and the evaluation results (The unit of the numerical values of the composition is mass %.)

| | Comparative Examples | | | | | Base |
|---|---|---|---|---|---|---|
| | 1 | 2 | 3 | 4 | 5 | Composition |
| A-1 | | 5 | | 1 | | |
| A-2 | 1 | | | | | |
| B-1 | 22 | | 22 | | | |
| B-2 | | | | 22 | 22 | 22 |
| Moiety of component B corresponding to C-1 | 0.2 | 0.0 | 0.2 | 0.0 | 0.0 | 0.0 |
| C-1-1 | 0.2 | 0.2 | 0.2 | | | |
| C-1-2 | | | | | | |
| C-2-1 | | | | | | |
| C-2-2 | | | | | 0.2 | |
| C-2-3 | | | | | | |
| C-3-1 | | | | | | |
| Nonion | 2 | 2 | 2 | 2 | 2 | 2 |
| Calcium chloride | 0.8 | 0.8 | 0.8 | 0.8 | 0.8 | 0.8 |
| Perfume composition | 0.8 | 0.8 | 0.8 | 0.8 | 0.8 | 0.8 |
| Deionized water | Balance | | | | | |
| Total of component C | 0.4 | 0.2 | 0.4 | 0 | 0.2 | 0 |
| A/B | 0.05 | — | 0.00 | 0.05 | 0.00 | 0.00 |
| A/C | 2.5 | 25 | 0.00 | — | 0.00 | — |
| Smell from sweat | 0.85 | 0.20 | 0.05 | 0.90 | 0.00 | — |
| Smell from indoor drying | 0.70 | 0.60 | 0.30 | 0.80 | 0.00 | — |

Test Example 2

[Component (A)]

A-1: Cluster Dextrin (registered trademark, made by Glico Nutrition Co., Ltd.)

The Cluster Dextrin (registered trademark) is chiefly composed of a dextrin with a molecular weight of about 30,000 to about 1,000,000 which has in the molecule thereof one cyclic structure to which a number of glucan chains are bonded, with a weight average degree of polymerization of about 2,500. The cyclic structure portion has about 16 to about 100 glucose units, with lots of noncyclic branched glucan chains being bonded to the cyclic structure.

[Component (B)]

B-1: Cationic surfactant (the same compound as described in Example 4 of JP 2003-12471 A except that ethanol was not added)

The surfactant B-1 is considered to comprise a fatty acid derived from the preparation process. When the component B-1 is contained in an amount of 22 mass % based on the total mass of the composition, the content of the fatty acid is considered to reach about 0.2 mass % based on the total mass of the composition.

[Component (D)]

D-1: Ethanol (Japan Synthetic Alcohol Co., Ltd.)

D-2: Glycerin (Sakamoto Yakuhin Kogyo Co. Ltd.)

D-3: PEG1000 (Lion Chemical Co., Ltd.)

D-4: Dipropylene glycol monomethyl ether (The Dow Chemical Company)

D-5: 2-phenoxyethanol (Tokyo Chemical Industry Co., Ltd.)

D-6: Triethanolamine (Tokyo Chemical Industry Co., Ltd.)

[Component (E)]

E-1: Trehalose (Hayashibara Co., Ltd.)

E-2: Sorbitol (Tokyo Chemical Industry Co., Ltd.)

[Optional Components]

(1) Nonionic surfactant: 60 mole ethylene oxide adduct of primary isotridecyl alcohol with (in which ethylene oxide is added to Lutensol T03 made by BASF Japan Ltd.).

This nonionic surfactant was used at a concentration of 2% in the resultant treatment composition for textile goods (softener composition).

(2) Calcium chloride (Calcium chloride (granular), made by Tokuyama Corporation)

The calcium chloride was used at a concentration of 0.8% in the resultant treatment composition for textile goods (softener composition).

(3) Perfume ingredients

A perfume composition A as previously shown in Table 1 was used at a concentration of 0.8% in the resultant treatment composition for textile goods (softener composition).

(4) SM8904 (made by Dow Corning Toray Co., Ltd. The added amount is expressed in terms of pure content, provided that the pure content is 40%.)

(5) Wacker FC201 (made by Wacker Asahikasei Silicone Co., Ltd. The added amount is expressed in terms of pure content, provided that the pure content is 60%.)

(6) KF-864 (made by Shin-Etsu Chemical Co., Ltd.)

[Preparation Method of Treatment Composition for Textile Goods (Softener Composition)]

The predetermined amounts of the components were weighed in accordance with the formulations as shown in the following Table 5, and liquid treatment compositions for textile goods (softener compositions) were prepared according to the following procedures, using a glass vessel with an inner diameter of 100 mm and a height of 150 mm and an agitator (Agitor Model SJ, made by Shimadzu Corporation). The component (B) and the optional components (1) and (3) were mixed and then stirred to obtain an oil phase mixture. The component (A) was dissolved in deionized water (used as the balance of each composition) to obtain an aqueous phase mixture. The mass of the above-mentioned deionized water corresponds to the difference obtained by subtracting the total amounts of the oil phase mixture, the component (A), the component (D), and the optional components (1) to (6) from 980 g. The oil phase mixture heated to a temperature equal to or higher than the melting point of the component (B) was placed into the glass vessel. Then, the aqueous phase mixture heated to a temperature equal to or higher than the melting point of the component (B) was added to the oil phase mixture in two divided portions with stirring, followed by further stirring. The ratio by mass of the divided portions of the aqueous phase mixture was 30:70. The stirring was conducted at 1,000 rpm for three minutes after addition of the first portion of the aqueous phase mixture, and for two minutes after addition of the second portion of the aqueous phase mixture. Thereafter, the components (D) and the optional component (2) were added to the mixture, and as necessary, hydrochloric acid (1 mol/L, reagent made by Kanto Chemical Co., Inc.) or sodium hydroxide (1 mol/L, reagent made by Kanto Chemical Co., Inc.) was appropriately added to adjust the pH to 2.5. Finally, deionized water was added until the total mass reached 1,000 g, thereby obtaining desired treatment compositions for textile goods (softener compositions of Examples 27 to 47 and Comparative Examples 6 and 7). The optional components (4) and (5) were added after completion of the addition of the optional component (2); and the optional component (6) was added after the component (B) and the optional components (1) and (3) were mixed and stirred.

[Evaluation of Deodorizing and Odor Preventing Effect Against Smell Resulting from Cigarette]

1. Pretreatment of Cloth Used for Evaluation

Commercially available knitted cotton fabrics (made by Tanigashira Shoten) were subjected to a pretreatment process three times in a twin-tub washing machine (Model CW-C30A1-H, made by Mitsubishi Electric Corporation) using a commercially available laundry detergent TOP Platinum Clear (made by Lion Corporation). (The conditions of the pretreatment process are as follows: a standard use level of the laundry detergent; a bath ratio of 30 times; tap water of 45° C.; and the washing operation for 10 minutes followed by the water pouring and rinsing operation for 10 minutes repeated two times.)

2. Treatment in the Rinsing Operation in the Washing Cycle

The knitted cotton fabrics thus pretreated were treated with any composition obtained in Examples and Comparative Examples. The treatment was conducted in a twin-tub washing machine (Model CW-C30A1-H, made by Mitsubishi Electric Corporation) in a standard mode, using the commercially available laundry detergent TOP Platinum Clear (made by Lion Corporation) at a standard use level and the treatment composition (in an amount of 10 mL with respect to 1.5 kg of the knitted cotton fabrics). Then, the knitted cotton fabrics were dried for 20 hours under thermostatically and humidistatically controlled conditions of 20° C. and 45% RH.

3. Evaluation of Deodorizing and Odor Preventing Effects

A piece of knitted cotton fabric (10 cm×10 cm) was hung from the ceiling in a cardboard box (50 cm long, 30 cm broad and 50 cm deep), and one lit cigarette ("Mild Seven") was placed on the bottom of the cardboard box. The cardboard box was tightly sealed and allowed to stand for one minute. Then, the cardboard box was opened. The organoleptic test was conducted by a panel of five professional members. The results are shown in Table 5.

<Evaluation Criteria>

+2: Distinctly better than the control

+1: Somewhat better than the control

0: Almost the same as the control

−1: The control was somewhat better

−2: The control was distinctly better.

Control: Comparative Example 6

[Evaluation of Preservation Stability]

1. Restorability of Frozen Composition 650 ml of each compositions obtained in Examples and Comparative Examples was poured into an empty container of "Kaori to Deodorant no SOFLAN" (made by Lion Corporation) and stored at −15° C. for 40 hours and then 25° C. for 8 hours. The above-mentioned storage cycle was repeated three times. After that, the usability at the time when the composition was put into a measuring cap up to the level of 20 ml, and charged into a feeder of a fully automatic washing machine (ease of use in measuring the composition by the cap and charging the composition held in the cap into the feeder) was evaluated (n=10, average).

2. High-Temperature Preservation Stability 650 ml of each composition obtained in Examples and Comparative Examples was poured into an empty container of "Kaori to Deodorant no SOFLAN" (made by Lion Corporation) and stored in a thermostatic chamber of 40° C. for 6 months. After that, the usability at the time when the composition was put into a measuring cap up to the level of 20 ml, and charged into a feeder of a fully automatic washing machine (ease of use in measuring the composition by the cap and charging the composition held in the cap into the feeder) was evaluated (n=10, average).

<Evaluation Criteria>

Score 3: Very easy to use.

Score 2: Somewhat easy to use.

Score 1: Neither easy to use nor uneasy to use—rather uneasy to use.

<Criteria of Judgment>

The score of 2 or more was regarded as acceptable.

[Smell]

20 ml of each composition obtained in Examples and Comparative Examples was poured into a cap of "Kaori to Deodorant no SOFLAN" (made by Lion Corporation) to evaluate the smell of the composition (n=5).

<Evaluation Criteria>

○: The number of panel members answering that there was no problem of smell as a fabric softener was four or more.

Δ: The number of panel members answering that there was no problem of smell as a fabric softener was two or three.

x: The number of panel members answering that there was no problem of smell as a fabric softener was one or less.

TABLE 5

Treatment compositions for textile goods (softener compositions) according to Examples and Comparative Examples and the evaluation results (The unit of the numerical values of the composition is mass %.)

| | Examples | | | | | | | | | | | |
|---|---|---|---|---|---|---|---|---|---|---|---|---|
| | 27 | 28 | 29 | 30 | 31 | 32 | 33 | 34 | 35 | 36 | 37 | 38 |
| A-1 | 0.5 | 0.5 | 0.5 | 0.5 | 0.5 | 0.5 | 0.5 | 0.5 | 0.5 | 0.5 | 0.5 | 0.5 |
| B-1 | 20 | 20 | 20 | 20 | 20 | 20 | 20 | 20 | 20 | 20 | 20 | 20 |
| D-1 | 4 | | 4 | | 4 | 4 | | 4 | 4 | 4 | 20 | 4 |
| D-2 | | 3 | 3 | | | | | | | 5 | 3 | 3 |
| D-3 | | | | 3 | 3 | | | | | | | |
| D-4 | | | | | | 3 | | | | | | |
| D-5 | | | | | | | 3 | 3 | | | | |
| D-6 | | | | | | | | | 3 | | | |
| E-1 | | | | | | | | | | | | 3 |
| E-2 | | | | | | | | | | | | |
| (1) Nonionic surfactant | 2 | 2 | 2 | 2 | 2 | 2 | 2 | 2 | 2 | 2 | 2 | 2 |
| (2) $CaCl_2$ | 0.8 | 0.8 | 0.8 | 0.8 | 0.8 | 0.8 | 0.8 | 0.8 | 0.8 | 0.8 | 0.8 | 0.8 |
| (3) Perfume composition | 0.8 | 0.8 | 0.8 | 0.8 | 0.8 | 0.8 | 0.8 | 0.8 | 0.8 | 0.8 | 0.8 | 0.8 |
| (4) SM8904 | | | | | | | | | | | | |
| (5) WACKER FC201 | | | | | | | | | | | | |
| (6) KF-864 | | | | | | | | | | | | |
| A/D | 0.13 | 0.17 | 0.07 | 0.17 | 0.07 | 0.07 | 0.17 | 0.07 | 0.07 | 0.06 | 0.02 | 0.07 |
| Restorability of frozen composition | 2.1 | 2.4 | 2.6 | 2.3 | 2.5 | 2.5 | 2.2 | 2.3 | 2.5 | 2.7 | 2.8 | 2.9 |
| High-temperature preservation stability | 2.1 | 2.2 | 2.3 | 2.2 | 2.3 | 2.3 | 2.4 | 2.5 | 2.2 | 2.2 | 2.3 | 2.9 |
| Deodorizing and odor preventing effects against cigarette smell | 1.6 | 1.6 | 1.6 | 1.6 | 1.6 | 1.6 | 1.6 | 1.6 | 1.6 | 1.6 | 1.6 | 1.6 |
| Offensive smell | ○ | ○ | ○ | ○ | ○ | ○ | ○ | ○ | ○ | ○ | Δ | ○ |

Treatment compositions for textile goods (softener compositions) according to Examples and Comparative Examples and the evaluation results (The unit of the numerical values of the composition is mass %.)

| | Examples | | | | | | | | | Comparative Examples | |
|---|---|---|---|---|---|---|---|---|---|---|---|
| | 39 | 40 | 41 | 42 | 43 | 44 | 45 | 46 | 47 | 6 | 7 |
| A-1 | 0.5 | 0.08 | 5.1 | 0.5 | 0.5 | 0.5 | 0.5 | 1 | 0.5 | | |
| B-1 | 20 | 20 | 20 | 20 | 20 | 20 | 20 | 15 | 20 | 20 | 20 |
| D-1 | 4 | 4 | 4 | 7 | 4 | 4 | 4 | 3 | | | 4 |
| D-2 | 3 | 3 | 3 | | 3 | 3 | 3 | | | | |
| D-3 | | | | | | | | | | | |
| D-4 | | | | | | | | | | | |
| D-5 | | | | | | | | | | | |
| D-6 | | | | | | | | | | | |
| E-1 | | | | | 3 | 3 | 3 | | | | |
| E-2 | 3 | | | | | | | | | | |
| (1) Nonionic surfactant | 2 | 2 | 2 | 2 | 2 | 2 | 2 | 2 | 2 | 2 | 2 |
| (2) $CaCl_2$ | 0.8 | 0.8 | 0.8 | 0.8 | 0.8 | 0.8 | 0.8 | 0.8 | 0.8 | 0.8 | 0.8 |
| (3) Perfume composition | 0.8 | 0.8 | 0.8 | 0.8 | 0.8 | 0.8 | 0.8 | 0.8 | 0.8 | 0.8 | 0.8 |
| (4) SM8904 | | | | | 2 | | | | | | |
| (5) WACKER FC201 | | | | | | 2 | | | | | |
| (6) KF-864 | | | | | | | 2 | | | | |
| A/D | 0.07 | 0.01 | 0.73 | 0.07 | 0.07 | 0.07 | 0.07 | 0.33 | | | |
| Restorability of frozen composition | 2.6 | 3 | 2.4 | 2.2 | 2.8 | 2.8 | 2.7 | 2.8 | 1 | 3 | 3 |
| High-temperature preservation stability | 2.8 | 3 | 2.2 | 2.1 | 2.8 | 2.8 | 2.7 | 2.8 | 1.1 | 3 | 3 |

TABLE 5-continued

| | | | | | | | | | | | |
|---|---|---|---|---|---|---|---|---|---|---|---|
| Deodorizing and odor preventing effects against cigarette smell | 1.6 | 1.2 | 2 | 1.6 | 1.8 | 1.8 | 1.8 | 2 | 1.6 | | 0 |
| Offensive smell | ○ | ○ | ○ | ○ | ○ | ○ | ○ | ○ | ○ | ○ | ○ |

The results of Example 47 where the component (D) was not contained were inferior to those where the component (D) was contained with respect to the restorability of the frozen composition and the high-temperature preservation stability, but the deodorizing and odor preventing effects were found to be satisfactory.

Test Example 3

[Component (A)]

A-1: Cluster Dextrin (registered trademark, made by Glico Nutrition Co., Ltd.)

The Cluster Dextrin (registered trademark) is chiefly composed of a dextrin with a molecular weight of about 30,000 to about 1,000,000 which has in the molecule thereof one cyclic structure to which a number of glucan chains are bonded, with a weight average degree of polymerization of about 2,500. The cyclic structure portion has about 16 to about 100 glucose units, with lots of noncyclic branched glucan chains being bonded to the cyclic structure.

A-3 (Comparative Example): hydroxypropyl-β-cyclodextrin (Celldex HP-β-CD, made by Nihon Shokuhin Kako Co., Ltd.)

[Component (B)]

B-1: Cationic surfactant (the compound described in Example 4 of JP 2003-12471 A)

The surfactant B-1 is considered to comprise a fatty acid derived from the preparation process. When the component B-1 is contained in an amount of 22 mass % based on the total mass of the composition, the content of the fatty acid is considered to reach about 0.2 mass % based on the total mass of the composition.

B-3: Cationic surfactant (the compound described in Example 1 of JP 2002-167366 A)

The surfactant B-3 is considered to comprise a fatty acid derived from the preparation process.

B-4: Cationic surfactant prepared in the following manner:

The procedures described in Example 1 of JP H5-230001 A were repeated except that stearic acid was replaced by hydrogenated beef tallow fatty acid and the step of quaternization was not carried out, so that 300 g of a tertiary amine (i.e., the compound represented by the above-mentioned formula (D1-7)) was obtained.

The acid value, saponification value, hydroxyl number, total amine value and tertiary amine value of the obtained reaction product were determined to examine the composition thereof. As a result, it was found that the composition contained 86 mass % of dialkyl moiety, 10 mass % of monoalkylamide moiety and 4 mass % of unreacted fatty acid. The analysis of the composition by gas chromatography demonstrated that unreacted N-(2-hydroxyethyl)-N-methyl-1,3-propylenediamine was contained in an amount of 0.1 mass % in the reaction product. Finally, 53 g of 99% synthetic ethanol (made by Nihon Ethanol Co., Ltd.) was added to prepare an ethanol solution containing 85 mass % of a solid content.

The compound B-4 is considered to comprise a fatty acid derived from the preparation process.

B-5: Didecyldimethylammonium salt (ARQUAD 210 (trade name), made by Lion Akzo Co., Ltd.)

The compound B-5 does not comprise any fatty acid.

[Component (F)]

F-1: Butylated hydroxytoluene (Ionol CP (trade name), made by Japan Chemtech Ltd.)

F-2: 2,2'-ethylidenebis(4,6-di-t-butylphenol) (made by Aldrich)

F-3: p-methoxyphenol (MQ-F (trade name), made by Kawaguchi Chemical Industry Co., Ltd.)

F-4: γ-oryzanol (Oryza Gamma V (trade name), made by Ichimaru Pharcos Co., Ltd.)

[Nonionic Surfactant]

(1) Polyoxyethylene isotridecyl ether E060 moles (Ethylene oxide adduct of Lutensol T03 (made by BASF Japan Ltd.)) (The term "E060 moles" means that the average addition molar number of ethylene oxide is 60.)

(2) Polyoxyethylene lauryl ether E020 moles (Emalex 720 (trade name), made by Nihon Emulsion Co., Ltd) (The term "E020 moles" means that the average addition molar number of ethylene oxide is 20.)

(3) Polyoxyethylene lauryl ether E08 moles (Newcol 1100 (trade name), made by Nippon Nyukazai Co., Ltd) (The term "E08 moles" means that the average addition molar number of ethylene oxide is 8.)

(4) Glyceryl monostearate (Emalex GMS-F (trade name), made by Nihon Emulsion Co., Ltd.)

[Amphoteric Surfactant]

N-lauroylamidopropyl-N,N-dimethylamine oxide (Softazoline LAO (trade name), made by Kawaken Fine Chemicals, Co., Ltd.)

[Anionic Surfactant]

Straight-chain alkyl (C10-14) benzenesulfonic acid (Lipon LH-200 (trade name), made by Lion Corporation)

[Other Optional Components Used in Common]

H-1:

95% synthetic ethanol (Junsei Chemical Co., Ltd.)

This product was used at a concentration of 3% in the resultant treatment composition for textile goods (softener composition).

Calcium chloride (Calcium chloride (granular), made by Tokuyama Corporation)

The calcium chloride was used at a concentration of 0.5% in the resultant treatment composition for textile goods (softener composition).

Perfume ingredients

A perfume composition B having a formulation shown in the following Table 6 was used at a concentration of 0.8 mass % in the resultant treatment composition for textile goods (softener composition).

Liquid of isothiazolone (Kathon CG-ICP (trade name), made by Rohm and Haas Company)

This product was used at a concentration of 100 ppm in the resultant treatment composition for textile goods (softener composition).

H-2:

95% synthetic ethanol (Junsei Chemical Co., Ltd.)

This product was used at a concentration of 10% in the resultant treatment composition for textile goods (spray type fabric treatment composition).

Perfume ingredients

A perfume composition C having a formulation shown in the following Table 6 was used at a concentration of 0.2 mass % in the resultant treatment composition for textile goods (spray type fabric treatment composition).

TABLE 6

| Perfume Compositions | | |
|---|---|---|
| Perfume Ingredients | Perfume Composition B | Perfume Composition C |
| Ambroxan | 2 | 3 |
| Iso E super | 2 | 1 |
| γ-undecalactone | 2 | 1 |
| Ethylvanillin | 2 | 0 |
| Eugenol | 1 | 2 |
| Orange oil | 2 | 1 |
| Cashmeran | 3 | 2 |
| Galaxolide (25% dipropylene glycol solution) | 3 | 5 |
| Coumarine | 1 | 2 |
| Geraniol | 2 | 1 |
| Citral | 1 | 0 |
| Citronellol | 1 | 0 |
| Dihydromyrcenol | 3 | 3 |
| Dibutylhydroxytoluene | 2 | 3 |
| Dipropylene glycol | 2 | 2 |
| Dimethylbenzyl carbinyl acetate | 2 | 2 |
| Geranium oil | 2 | 1 |
| Terpineol | 2 | 1 |
| Damascenone | 1 | 3 |
| 1-decanal (10% dipropylene glycol solution) | 1 | 2 |
| Tetrahydrolinalol | 4 | 1 |
| Tranide | 3 | 6 |
| Tripral | 1 | 1 |
| Phenylethyl alcohol | 5 | 3 |
| Hexyl cinnamic aldehyde | 4 | 6 |
| β-ionone | 3 | 5 |
| Hedion | 5 | 6 |
| Beltfix | 5 | 3 |
| Benzyl salicylate | 2 | 1 |
| Eucalyptus oil | 1 | 3 |
| Methyl ionone | 2 | 2 |
| Lime oil | 4 | 2 |
| Linalyl acetate | 1 | 2 |
| Linalol | 1 | 1 |
| Limonene | 3 | 5 |
| Lyral | 6 | 4 |
| Lilial | 7 | 10 |
| Lemon oil | 4 | 2 |
| Rose base | 2 | 2 |
| Total | 100 | 100 |

the unit of the numerical values shown in Table is mass %.

[Preparation Method of Treatment Composition for Textile Goods (Softener Composition)]

The predetermined amounts of the components were weighed in accordance with the formulations as shown in the following Tables 7 to 9, and softener compositions were prepared according to the following procedures, using a glass vessel with an inner diameter of 100 mm and a height of 150 mm and an agitator (Agitor Model SJ, made by Shimadzu Corporation). The component (F), the surfactants and the perfume composition used as the common component were mixed and then stirred to obtain an oil phase mixture. The component (A) was dissolved in deionized water (used as the balance of each composition) to obtain an aqueous phase mixture. The mass of the above-mentioned deionized water corresponds to the difference obtained by subtracting the total amounts of the oil phase mixture and the component (A) from 980 g. The oil phase mixture heated to a temperature equal to or higher than the melting point of the nonionic surfactant was placed into the glass vessel. Then, the aqueous phase mixture heated to a temperature equal to or higher than the melting point of the nonionic surfactant was added to the oil phase mixture in two divided portions with stirring, followed by further stirring. The ratio by mass of the divided portions of the aqueous phase mixture was 30:70. The stirring was conducted at 1,000 rpm for three minutes after addition of the first portion of the aqueous phase mixture, and for two minutes after addition of the second portion of the aqueous phase mixture. Thereafter, the calcium chloride as the common component was added to the mixture, and as necessary, hydrochloric acid (1 mol/L, reagent made by Kanto Chemical Co., Inc.) or sodium hydroxide (1 mol/L, reagent made by Kanto Chemical Co., Inc.) was appropriately added to adjust the pH to 2.5. Finally, deionized water was added until the total mass reached 1,000 g, thereby obtaining desired softener compositions (Examples 48 to 64 and Comparative Examples 8 and 9).

[Evaluation of Change in Appearance]

Each softener composition (70 g) was placed into a light-weight glass bottle (PS-No. 11, made by Tanuma Glass Kogyo-sho) and the bottle was hermetically sealed as a sample for evaluation. The bottle was stored at 40° C. for 60 days.

After the above-mentioned durability test, the color tone of the liquid-form sample composition at 25° C. was compared with that of the liquid-form composition stored at 5° C. Visual evaluation was made by twenty panel members in accordance with the following criteria. The average score of Δ or more was regarded as acceptable in terms of the commercial value.

<Evaluation Criteria>

◎◎◎: The number of panel members recognizing some change in color tone was one or two of twenty.

◎◎: The number of panel members recognizing some change in color tone was three or four of twenty.

◎: The number of panel members recognizing some change in color tone was five or six of twenty.

○: The number of panel members recognizing some change in color tone was seven or eight of twenty.

Δ: The number of panel members recognizing some change in color tone was nine or ten of twenty.

x: The number of panel members recognizing some change in color tone was 11 or more of twenty.

[Preparation Method of Treatment Compositions for Textile Goods (Spray Type Fabric Treatment Compositions)]

In a 500-mL beaker, a solution prepared by dissolving the component (F) in the 95% synthetic ethanol used as the common component and an aqueous solution of the component (A) were mixed together in advance. A solution prepared by dissolving the surfactants and other common components in deionized water (adjusted to pH 5.0 by appropriately adding diluted sulfuric acid (0.1 mol/L, reagent made by Kanto Chemical Co., Inc.) or sodium hydroxide (0.1 mol/L, reagent made by Kanto Chemical Co., Inc.) when necessary, with the mass of deionized water being adjusted so as to have a total mass of 400 g) was added to the mixture prepared in advance, with stirring. The desired spray type fabric treatments were thus obtained as shown in the following Tables 10 to 12 (Reference Examples 1 to 16 and Comparative Examples 10 and 11). The change in appearance of the spray type fabric treatments was evaluated in the same manner as in the case of the softener compositions.

[Evaluation of Smell Resulting from Sebum]

1. Pretreatment of Knitted Cotton Fabrics Used for Evaluation

Pieces (10 cm×10 cm) of knitted cotton fabrics (made of 100% cotton by Tanigashira Shoten) were subjected to a pretreatment process three times in a twin-tub washing machine (Model VH-30S, made by Toshiba Corporation) using a commercially available laundry detergent TOP Platinum Clear (made by Lion Corporation). (The conditions of the pretreatment process are as follows: a standard use level of the laundry detergent; a bath ratio of 30 times; tap water of 50° C.; and the washing operation for 10 minutes followed by the water pouring and rinsing operation for 10 minutes repeated two times.) The pieces of cotton fabrics thus pretreated were coated with oleic acid (made by Tokyo Chemical Industry Co., Ltd.) serving as a model of sebum at 0.5% o.w.f (i.e., the mass of oleic acid (g)/the mass of fabrics used for evaluation (g)×100). Thus, fabrics for evaluation were prepared.

2-1. Treatment in the Rinsing Operation in the Washing Cycle and Evaluation of Smells Resulting from Sebum One group of knitted cotton fabrics thus pretreated was subjected to the washing cycle using the treatment composition for textile goods (softener composition), and the other group was subjected to the washing cycle just using water without any treatment composition for textile goods (softener composition). The knitted cotton fabrics of both groups were allowed to stand in a thermostatic chamber of 70° C. for 4 hours. Then, the smell of the fabrics was evaluated in a panel of 20 members by the organoleptic evaluation according to the evaluation criteria shown below. The score of Δ or more was regarded as acceptable in terms of the commercial value.

The treatment was conducted as follows. Using a twin-tub washing machine (Model VH-30S, made by Toshiba Corporation), the knitted cotton fabrics were washed for 10 minutes in a standard mode at a bath ratio of 20 times using tap water of 25° C. with the addition of the commercially available laundry detergent TOP Platinum Clear (made by Lion Corporation) at a standard use level. Subsequently to the first rinsing operation for 3 minutes, the second rinsing operation was conducted for 3 minutes where the cotton fabrics were treated with 10 mL of the softener composition (with respect to 1.5 kg of the knitted cotton fabrics) in tap water of 25° C. at a bath ratio of 20 times. One minute's spinning operation was provided after the washing operation and each rinsing operation. Finally, the fabrics were dried for 20 hours under thermostatically and humidistatically controlled conditions of 20° C. and 45% RH.

<Evaluation Criteria>

◎◎◎: The number of panel members evaluating that less offensive smell was given compared to when using no softener was 19 or more of 20.

◎◎: The number of panel members evaluating that less offensive smell was given compared to when using no softener was 17 to 18 of 20.

◎: The number of panel members evaluating that less offensive smell was given compared to when using no softener was 15 to 16 of 20.

○: The number of panel members evaluating that less offensive smell was given compared to when using no softener was 13 to 14 of 20.

Δ: The number of panel members evaluating that less offensive smell was given compared to when using no softener was 11 to 12 of 20.

x: The number of panel members evaluating that less offensive smell was given compared to when using no softener 10 or less.

2-2. Treatment by Spraying Operation and Evaluation of Smells Resulting from Sebum One group of knitted cotton fabrics pretreated was subjected to spraying of the treatment composition for textile goods (spray type fabric treatment composition) filled into a trigger-type bottle, and the other group was subjected to spraying of water instead of the fabric treatment composition. The knitted cotton fabrics of both groups were allowed to stand in a thermostatic chamber of 70° C. for 4 hours. Then, the smell of the fabrics was evaluated in a panel of 20 members by the organoleptic evaluation according to the evaluation criteria shown below. The score of Δ or more was regarded as acceptable in terms of the commercial value.

In the treatment by spraying operation, a container of the commercially available clothing spray (Style-Guard Siwamo-Nioi-mo Sukkiri Spray (trade name), made by Lion Corporation) whose content was removed from the container and which was completely washed and sufficiently dried was prepared as the trigger-type bottle. The fabric treatment composition was filled into the trigger-type bottle, and uniformly sprayed onto the cotton fabrics for evaluation in an amount of 2% o.w.f (i.e., the mass of treatment composition (g)/the mass of fabrics used for evaluation (g)×100).

<Evaluation Criteria>

◎◎◎: The number of panel members evaluating that less offensive smell was given compared to when using no softener was 19 or more of 20.

◎◎: The number of panel members evaluating that less offensive smell was given compared to when using no softener was 17 to 18 of 20.

◎: The number of panel members evaluating that less offensive smell was given compared to when using no softener was 15 to 16 out of 20.

○: The number of panel members evaluating that less offensive smell was given compared to when using no softener was 13 to 14 of 20.

Δ: The number of panel members evaluating that less offensive smell was given compared to when using no softener was 11 to 12 of 20.

x: The number of panel members evaluating that less offensive smell was given compared to when using no softener was 10 or less of 20.

[Evaluation of Smell Resulting from Cigarette]

1. Pretreatment of Cloth Used for Evaluation

Commercially available knitted cotton fabrics (Tanigashira Shoten) were subjected to a pretreatment process three times in a twin-tub washing machine (Model VH-30S, made by Toshiba Corporation) using a commercially available laundry detergent TOP Platinum Clear (made by Lion Corporation). (The conditions of the pretreatment process are as follows: a standard use level of the laundry detergent; a bath ratio of 30 times; tap water of 45° C.; and the washing operation for 10 minutes followed by the water pouring and rinsing operation for 10 minutes repeated two times.)

2-1. Treatment in the Rinsing Operation in the Washing Cycle

Using a twin-tub washing machine (Model VH-30S, made by Toshiba Corporation), the knitted cotton fabrics (1.0 kg, Tanigashira Shoten) thus pretreated were washed for 8 minutes in a standard mode at a bath ratio of 15 times, using the commercially available laundry detergent TOP Platinum Clear (made by Lion Corporation) and tap water of 25° C. Subsequently to the first rinsing operation for 3 minutes, the second rinsing operation was conducted for 3 minutes where the cotton fabrics were treated with each softener composition (6.67 mL) prepared as mentioned above in tap water of 25° C. at a bath ratio of 20 times. One minute's spinning operation was provided after the washing operation and each rinsing operation. Finally, the fabrics were dried for 20 hours under thermostatically and humidistatically controlled conditions of 20° C. and 45% RH. Those fabrics were then subjected to the evaluation test shown below.

2-2. Treatment by Spraying Operation

One group of knitted cotton fabrics pretreated was subjected to spraying of the fabric treatment composition filled into a trigger-type bottle, and the other group was subjected to spraying of water instead of the fabric treatment composition. The knitted cotton fabrics of both groups were dried for 20 hours under thermostatically and humidistatically controlled conditions of 20° C. and 45% RH. Then, those knitted cotton fabrics were subjected to the evaluation test shown below.

In the treatment by spraying operation, a container of the commercially available clothing spray (Style-Guard Siwamo-Nioi-mo Sukkiri Spray (trade name), made by Lion Corporation) whose content was removed from the container and which was completely washed and sufficiently dried was prepared as the trigger-type bottle. The spraying operation was uniformly conducted in an amount of 2% o.w.f (i.e., the mass of treatment composition (g)/the mass of fabrics used for evaluation (g)×100).

3. Evaluation of Odor Resulting from Cigarette

The knitted cotton fabrics thus treated were cut into square pieces of 15 cm×15 cm. The pieces of knitted cotton fabrics were hung from the ceiling in a cardboard box (50 cm long, 30 cm broad and 50 cm deep), and one lit cigarette (Mild Seven, made by Japan Tobacco Inc.) was placed on the bottom of the cardboard box. The cardboard box was tightly sealed and allowed to stand for 10 seconds. After the cigarette was removed from the box, the box was again tightly sealed for 60 seconds, and then the pieces of cotton fabrics were taken out of the box. The degree of strength of cigarette smell on the knitted cotton fabrics treated with each of the compositions was rated in accordance with the following evaluation criteria. The average was calculated from the scores of 20 panel members. The score of Δ or more was regarded as acceptable in terms of the commercial value.

<Evaluation Criteria of Knitted Cotton Fabrics>

Score 5: Overpowering smell

Score 4: Strong smell

Score 3: Smell of an extent that can be easily perceived

Score 2: Weak smell of an extent that its source can be perceived

Score 1: Very faint smell of an extent that can be perceived in some way

Score 0: No smell

<Criteria of Judgment>

◎◎◎: less than 1.5

◎◎: 1.5 and more and less than 2.0

◎: 2.0 or more and less than 2.5

○: 2.5 or more and less than 3.0

Δ: 3.0 or more and less than 3.5 x: 3.5 or more

TABLE 7

| Examples | 48 | 49 | 50 | 51 | 52 | 53 | 54 | 55 | 56 | 57 |
|---|---|---|---|---|---|---|---|---|---|---|
| A-1 | 2.0 | 2.0 | 2.0 | 2.0 | 2.0 | 2.0 | 0.1 | 0.3 | 0.1 | 0.1 |
| A-2 | | | | | | | | | | |
| B-1 | 15 | 15 | 15 | 15 | 15 | 15 | 15 | 15 | 15 | 15 |
| B-3 | | | | | | | | | | |
| B-4 | | | | | | | | | | |
| F-1 | 0.5 | | | | 0.01 | 0.05 | 0.5 | 0.5 | 0.3 | 0.1 |
| F-2 | | 0.5 | | | | | | | | |
| F-3 | | | 0.5 | | | | | | | |
| F-4 | | | | 0.5 | | | | | | |
| Nonion (1) | 2 | 2 | 2 | 2 | 2 | 2 | 2 | 2 | 2 | 2 |
| Nonion (2) | | | | | | | | | | |
| Common Component | H-1 | H-1 | H-1 | H-1 | H-1 | H-1 | H-1 | H-1 | H-1 | H-1 |
| (F)/(A) | 0.25 | 0.25 | 0.25 | 0.25 | 0.005 | 0.025 | 5 | 1.67 | 3 | 1 |
| Change in appearance | ◎◎◎ | ◎◎ | ◎◎ | ◎ | ◎◎◎ | ◎◎◎ | Δ | ○ | ○ | ◎ |
| Smell from sebum | ◎◎◎ | ◎◎ | ◎ | ◎ | ○ | ◎ | ◎ | ◎ | ○ | Δ |
| Smell from cigerette | ◎◎◎ | ◎◎◎ | ◎◎◎ | ◎◎◎ | ◎◎◎ | ◎◎◎ | ○ | ◎ | ○ | ○ |

TABLE 8

| Examples | 58 | 59 | 60 | 61 | 62 | 63 | 64 |
|---|---|---|---|---|---|---|---|
| A-1 | 2.0 | 2.0 | 2.0 | 2.0 | 2.0 | 2.0 | 2.0 |
| A-2 | | | | | | | |
| B-1 | 3 | 5 | 8 | | | 15 | 22 |
| B-3 | | | | 15 | | | |
| B-4 | | | | | 15 | | |
| F-1 | 0.5 | 0.5 | 0.5 | 0.5 | 0.5 | 0.5 | 0.5 |
| F-2 | | | | | | | |
| F-3 | | | | | | | |
| F-4 | | | | | | | |
| Nonion (1) | 2 | 2 | 2 | 2 | 2 | | 2 |
| Nonion (2) | | | | | | 2 | |
| Common component | H-1 | H-1 | H-1 | H-1 | H-1 | H-1 | H-1 |
| (F)/(A) | 0.25 | 0.25 | 0.25 | 0.25 | 0.25 | 0.25 | 0.25 |
| Change in appearance | ◎◎◎ | ◎◎◎ | ◎◎◎ | ◎◎◎ | ◎◎◎ | ◎◎◎ | ◎◎◎ |
| Smell from sebum | ◎ | ◎◎ | ◎◎ | ◎◎◎ | ◎◎◎ | ◎◎◎ | ◎◎◎ |
| Smell from cigarette | ○ | ◎ | ◎◎ | ◎◎◎ | ◎◎◎ | ◎◎◎ | ◎◎◎ |

TABLE 9

| Comparative Examples | 8 | 9 |
|---|---|---|
| A-1 | | |
| A-2 | | 2.0 |
| B-1 | 15 | 15 |
| B-3 | | |
| B-4 | | |
| F-1 | 0.5 | 0.5 |
| F-2 | | |
| F-3 | | |
| F-4 | | |
| Nonion (1) | 2 | 2 |
| Nonion (2) | | |
| Common component | H-1 | H-1 |
| (F)/(A) | — | 0.25 |
| Change in appearance | X | X |
| Smell from sebum | ○ | ◎ |
| Smell from cigarette | X | ◎ |

TABLE 12

| Comparative Examples | 10 | 11 |
|---|---|---|
| A-1 | | |
| A-2 | | 0.2 |
| B-5 | 0.1 | 0.1 |
| F-1 | 0.05 | 0.05 |
| F-2 | | |
| F-3 | | |
| F-4 | | |
| Nonion (3) | 0.2 | 0.2 |
| Nonion (4) | | |
| Amphoteric surfactant | | |
| Common components | H-2 | H-2 |
| (F)/(A) | — | 0.25 |
| Change in appearance | X | X |
| Smell from sebum | ○ | ◎ |
| Smell from cigarette | X | ◎ |

TABLE 10

| Reference Examples | 1 | 2 | 3 | 4 | 5 | 6 | 7 | 8 |
|---|---|---|---|---|---|---|---|---|
| A-1 | 0.2 | 0.2 | 0.2 | 0.2 | 0.2 | 0.2 | 0.2 | 0.2 |
| A-2 | | | | | | | | |
| B-5 | 0.1 | 0.1 | 0.1 | 0.1 | | 0.2 | | 0.1 |
| F-1 | 0.05 | | | | 0.05 | 0.05 | 0.05 | 0.001 |
| F-2 | | 0.05 | | | | | | |
| F-3 | | | 0.05 | | | | | |
| F-4 | | | | 0.05 | | | | |
| Nonion (3) | 0.2 | 0.2 | 0.2 | 0.2 | 0.4 | 0.1 | 0.3 | 0.2 |
| Nonion (4) | | | | | | | | |
| Amphoteric surfactant | | | | | 0.1 | 0.1 | | |
| Anionic surfactant | | | | | | | 0.1 | |
| Common component | H-2 | H-2 | H-2 | H-2 | H-2 | H-2 | H-2 | H-2 |
| (F)/(A) | 0.25 | 0.25 | 0.25 | 0.25 | 0.25 | 0.25 | 0.25 | 0.005 |
| Change in appearance | ◎◎◎ | ◎◎ | ◎◎ | ◎ | ◎◎◎ | ◎◎◎ | ◎◎◎ | ◎◎◎ |
| Smell from sebum | ◎◎◎ | ◎◎ | ◎ | ◎ | ◎◎◎ | ◎◎◎ | ◎◎◎ | Δ |
| Smell from cigarette | ◎◎◎ | ◎◎◎ | ◎◎◎ | ◎◎◎ | ◎◎◎ | ◎◎◎ | ◎◎◎ | ◎◎◎ |

TABLE 11

| Reference Examples | 9 | 10 | 11 | 12 | 13 | 14 | 15 | 16 |
|---|---|---|---|---|---|---|---|---|
| A-1 | 0.2 | 0.01 | 0.03 | 0.01 | 0.01 | 0.2 | 0.2 | 0.2 |
| A-2 | | | | | | | | |
| B-5 | 0.1 | 0.1 | 0.1 | 0.1 | 0.1 | | 0.1 | |
| F-1 | 0.005 | 0.05 | 0.05 | 0.03 | 0.01 | 0.05 | 0.05 | 0.05 |
| F-2 | | | | | | | | |
| F-3 | | | | | | | | |
| F-4 | | | | | | | | |
| Nonion (3) | 0.2 | 0.2 | 0.2 | 0.2 | 0.2 | | | 0.2 |
| Nonion (4) | | | | | | | 0.2 | |
| Amphoteric surfactant | | | | | | | | |
| Anionic surfactant | | | | | | | | |
| Common component | H-2 | H-2 | H-2 | H-2 | H-2 | H-2 | H-2 | H-2 |
| (F)/(A) | 0.025 | 5 | 1.67 | 3 | 1 | 0.25 | 0.25 | 0.25 |
| Change in appearance | ◎◎◎ | Δ | ○ | ○ | ◎ | ◎◎◎ | ◎◎◎ | ◎◎◎ |
| Smell from sebum | ○ | ◎◎◎ | ◎◎◎ | ◎◎ | ◎ | ◎◎◎ | ◎◎◎ | ◎◎◎ |
| Smell from cigarette | ◎◎◎ | ○ | ◎ | ○ | Δ | ◎◎◎ | ◎◎◎ | ◎◎◎ |

Test Example 4

[Component (A)]

A-1: Cluster Dextrin (registered trademark, made by Glico Nutrition Co., Ltd.)

The Cluster Dextrin (registered trademark) is chiefly composed of a dextrin with a molecular weight of about 30,000 to about 1,000,000 which has in the molecule thereof one cyclic structure to which a number of glucan chains are bonded, with a weight average degree of polymerization of about 2,500. The cyclic structure portion has about 16 to about 100 glucose units, with lots of noncyclic branched glucan chains being bonded to the cyclic structure.

[Component (B)]

B-6: Cationic surfactant (the composition described as (A-3) in Example of JP 2010-47851 A)

This contains a monoester ammonium salt, a diester ammonium salt and a triester ammonium salt at a ratio by mass of 53/41/6.

The surfactant B-6 is considered to comprise a fatty acid derived from the preparation process.

B-7: Cationic surfactant (the composition described as the quaternary ammonium salt composition (3) in JP 2005-232637 A)

This contains a monoester ammonium salt, a diester ammonium salt and a triester ammonium salt at a ratio by mass of 55/41/4.

The surfactant B-7 is considered to comprise a fatty acid derived from the preparation process.

B-8: Cationic surfactant (the composition described as (A-2) in Example of JP 2010-47851 A)

This contains a monoester ammonium salt, a diester ammonium salt and a triester ammonium salt at a ratio by mass of 28/53/19.

The surfactant B-8 is considered to comprise a fatty acid derived from the preparation process.

B-9: Cationic surfactant (the composition described as the quaternary ammonium salt composition used in Example 3 of JP 2001-348784 A)

This contains a monoester ammonium salt and a diester ammonium salt at a ratio by mass of 19/81.

The surfactant B-9 is considered to comprise a fatty acid derived from the preparation process.

B-10: Cationic surfactant (ARQUAD T-800 (trade name), made by Lion Akzo Co., Ltd.)

The surfactant B-10 does not comprise any fatty acid.

[Component (G)]

G-1: Polyhexamethylene biguanide (Proxel IB (trade name), made by Lonza Japan K.K.)

G-2: Chlorhexidine hydrochloride (Chlorhexidine (trade name), made by Iwase Cosfa Co., Ltd.)

Antimicrobial −1 (Comparative): Triclosan (Irgasan DP300 (trade name), made by Ciba Specialty Chemicals Inc.)

[Common Components (I-1)]

Polyoxyethylene isotridecyl ether 60EO: 2%

Propylene glycol: 2%*

Calcium chloride: 0.3%

Direct blue 86: 30 ppm*

Perfume composition having a formulation shown in the following Table 13: 1%*

(*) The contents are those of propylene glycol, Direct blue 86 and perfume composition as they are.

TABLE 13

| Perfume composition | |
|---|---|
| Perfume Ingredients | Perfume Composition |
| Ambroxan | 2 |
| Iso E super | 2 |
| γ-undecalactone | 2 |
| Ethylvanillin | 2 |
| Eugenol | 1 |
| Orange oil | 2 |
| Cashmeran | 3 |
| Galaxolide (25% dipropylene glycol solution) | 3 |
| Coumarine | 1 |
| Geraniol | 2 |
| Citral | 1 |
| Citronellol | 1 |
| Dihydromyrcenol | 3 |
| Dibutylhydroxytoluene | 2 |
| Dipropylene glycol | 2 |
| Dimethylbenzyl carbinyl acetate | 2 |
| Geranium oil | 2 |
| Terpineol | 2 |
| Damascenone | 1 |
| 1-decanal (10% dipropylene glycol solution) | 1 |
| Tetrahydrolinalol | 4 |
| Tranide | 3 |
| Tripral | 1 |
| Phenylethyl alcohol | 5 |
| Hexyl cinnamic aldehyde | 4 |
| β-ionone | 3 |
| Hedion | 5 |
| Beltfix | 5 |
| Benzyl salicylate | 2 |
| Eucalyptus oil | 1 |
| Methyl ionone | 2 |
| Lime oil | 4 |
| Linalyl acetate | 1 |
| Linalol | 1 |
| Limonene | 3 |
| Lyral | 6 |
| Lilial | 7 |
| Lemon oil | 4 |
| Rose base | 2 |
| Total | 100 |

[Preparation Method of Treatment Composition for Textile Goods (Softener Composition)]

The predetermined amounts of the components were weighed in accordance with the formulations in Tables 14 to 16 shown below, and the treatment compositions for textile goods (softener compositions) were prepared according to the following procedures.

The component (B) was heated to a temperature equal to or higher than the melting point thereof and the predetermined amount thereof as shown in Tables 14 to 16 was placed into a glass vessel with an inner diameter of 100 mm and a height of 150 mm. Then, the predetermined amounts of the common components, i.e., the perfume composition, polyoxyethylene isotridecyl ether 60EO and propylene glycol were added to the component (B), followed by stirring, so that a homogeneous oil phase mixture was prepared.

Direct blue 86 and calcium chloride which are the common components were dissolved in the predetermined amount of deionized water, and the resultant solution was heated to 50° C. to prepare an aqueous phase mixture.

Then, the heated aqueous phase mixture was added to the oil phase mixture containing the component (B) in two divided portions. The ratio by mass of the first portion to the second portion of the aqueous phase mixture was 30:70. Three-One Motor (made by Shinto Scientific Co., Ltd.) was used to stir the mixture at 1,000 rpm for three minutes after addition of the first portion of the aqueous phase mixture, and for three minutes after addition of the second portion of the aqueous phase mixture. Paddle blades having three blades with a length of 100 mm disposed at intervals of 30 mm was used as an impeller.

Thereafter, while the resultant product was stirred at 200 rpm, the component (A) and the component (G) were further added, so that the treatment compositions for textile goods (softener compositions of Examples 65 to 79, Reference Example 17 and Comparative Example 12) were obtained. The pH of the obtained treatment compositions for textile goods (softener compositions) was in the range of 2.0 to 4.0 (at 25° C., an undiluted solution).

On the day after preparation, the treatment compositions for textile goods (softener compositions) were separately put into a glass bottle, and the bottle was covered tightly with the lid, which were referred to as "initial compositions". The above-mentioned treatment compositions were stored at 40° C. for four months, which were referred to as "compositions after storage". The initial compositions and the compositions after storage were subjected to the evaluation tests in terms of the soft feel, the strength of offensive smell of cloth left undried, and the strength of offensive smell resulting from cigarette. The results are shown in Tables 14 to 16.

[Evaluation of Soft Feel]

1. Pretreatment of Cloth Used for Evaluation

Commercially available cotton towels (made by Toshin Co., Ltd.) were subjected to a pretreatment process three times in a twin-tub washing machine (Model VH-30S, made by Toshiba Corporation) using a commercially available laundry detergent TOP Platinum Clear (made by Lion Corporation). (The conditions of the pretreatment process are as follows: a standard use level of the laundry detergent; a bath ratio of 30 times; tap water of 45° C.; and the washing operation for 10 minutes followed by the water pouring and rinsing operation for 10 minutes repeated two times.)

2. Treatment in the Rinsing Operation in the Washing Cycle

Using a twin-tub washing machine (Model VH-30S, made by Toshiba Corporation), 1.0 kg of the cotton towels (made by Toshin Co., Ltd.) thus pretreated were washed for 8 minutes in a standard mode at a bath ratio of 15 times with the commercially available laundry detergent TOP Platinum Clear (made by Lion Corporation) at a standard use level and tap water of 25° C. Subsequently to the first rinsing operation for 3 minutes, the second rinsing operation was conducted for 3 minutes where the towels were softening-treated with each of the above-mentioned softener compositions (6.67 ml) prepared as mentioned above in tap water of 25° C. at a bath ratio of 20 times. One minute's spinning operation was provided after the washing operation and each rinsing operation. Then, the towels were dried for 20 hours under thermostatically and humidistatically controlled conditions of 20° C. and 45% RH. Those towels were then subjected to the evaluation test shown below.

3. Evaluation of Soft Feel

Cotton towels treated in the same manner as mentioned above except that no softener composition was used in the above-mentioned rinsing operation were used as the control. The organoleptic pairwise comparison was evaluated by a panel of ten professional members according to the evaluation criteria shown below. The average score of the ten panel members was calculated and judged according to the criterion of judgment shown below.

<Evaluation Criteria>

+3: Distinctly better than the control

+2: Somewhat better than the control

+1: Slightly better than the control

0: Almost the same as the control

−1: The control was slightly better.

−2: The control was somewhat better.

−3: The control was distinctly better.

<Criterion of Judgment>

An average of the ten panel members' scores was calculated and judged according to the following criterion. The score of 1.0 or more was regarded as acceptable in terms of the commercial value.

[Evaluation of Offensive Smell of Cloth Left Undried]

1. Treatment in the Rinsing Operation in the Washing Cycle

Using a twin-tub washing machine (Model VH-305, made by Toshiba Corporation), 1.0 kg of cotton towels collected from households (that had been used as bath towels for about six months) were washed for 8 minutes in a standard mode at a bath ratio of 15 times with the commercially available laundry detergent TOP Platinum Clear (made by Lion Corporation) at a standard use level and tap water of 25° C. Subsequently to the first rinsing operation for 3 minutes, the second rinsing operation was conducted for 3 minutes where the towels were softening-treated with 6.67 ml of each of the above-mentioned softener compositions prepared as mentioned above in tap water of 25° C. at a bath ratio of 20 times. One minute's spinning operation was provided after the washing operation and each rinsing operation. After completion of the final spinning operation, the towels were left in the spin tub as they were for 3 hours. Those towels were then subjected to the evaluation test.

2. Evaluation of Offensive Smell Resulting from Towels Left Undried

The strength of offensive smell of the towels left undried as mentioned above after treated with each composition was rated in accordance with the evaluation criteria shown below. The average score of the ten panel members was calculated. In terms of the commercial value, the average score of less than 3.5 was regarded as acceptable.

<Evaluation Criteria with Respect to the Collected Bath Towels>

Score 5: Overpowering smell

Score 4: Strong smell

Score 3: Smell of an extent that can be easily perceived

Score 2: Weak smell of an extent that its source can be perceived

Score 1: Very faint smell of an extent that can be perceived in some way

Score 0: No smell

[Evaluation of Smell Resulting from Cigarette]

1. Pretreatment of Cloth Used for Evaluation

Commercially available knitted cotton fabrics (Tanigashira Shoten) were subjected to a pretreatment process three times in a twin-tub washing machine (Model VH-305, made by Toshiba Corporation) using a commercially available laundry detergent TOP Platinum Clear (made by Lion Corporation). (The conditions of the pretreatment process are as follows: a standard use level of the laundry detergent; a bath ratio of 30 times; tap water of 45° C.; and the washing operation for 10 minutes followed by the water pouring and rinsing operation for 10 minutes repeated two times.)

2. Treatment in the Rinsing Operation in the Washing Cycle

Using a twin-tub washing machine (Model VH-305, made by Toshiba Corporation), 1.0 kg of the knitted cotton fabrics (Tanigashira Shoten) thus pretreated were washed for 8 minutes in a standard mode at a bath ratio of 15 times with the commercially available laundry detergent TOP Platinum Clear (made by Lion Corporation) at a standard use level and tap water of 25° C. Subsequently to the first rinsing operation for 3 minutes, the second rinsing operation was conducted for 3 minutes where the cotton fabrics were softening-treated with each of the softener compositions (6.67 mL) prepared as mentioned above in tap water of 25° C. at a bath ratio of 20 times. One minute's spinning operation was provided after the washing operation and each rinsing operation. Finally, the fabrics were dried for 20 hours under thermostatically and humidistatically controlled conditions of 20° C. and 45% RH. Then, those fabrics were subjected to the evaluation test shown below.

3. Evaluation of Odor Resulting from Cigarette

The knitted cotton fabrics thus treated were cut into square pieces of 15 cm×15 cm. The pieces of knitted cotton fabrics were hung from the ceiling in a cardboard box (50 cm long, 30 cm broad and 50 cm deep), and one lit cigarette (Mild Seven, made by Japan Tobacco Inc.) was placed on the bottom of the cardboard box. The cardboard box was tightly sealed and allowed to stand for 10 seconds. After the cigarette was removed from the box, the box was again tightly sealed for 60 seconds, and then the pieces of cotton fabrics were taken out of the box. The degree of strength of cigarette smell on the knitted cotton fabrics treated with each compositions was rated in accordance with the following evaluation criteria. The average was calculated from the scores of 10 panel members. The score of less than 3.5 was regarded as acceptable in terms of the commercial value.

<Evaluation Criteria of Knitted Cotton Fabrics>

Score 5: Overpowering smell

Score 4: Strong smell

Score 3: Smell of an extent that can be easily perceived

Score 2: Weak smell of an extent that its source can be perceived

Score 1: Very faint smell of an extent that can be perceived in some way

Score 0: No smell

TABLE 14

Treatment compositions for textile goods (softener compositions) according to Examples and Reference Example and the evaluation results
(The unit of the numerical values of the composition is mass %.)

| Examples | | 65 | 66 | 67 | 68 | Ref. Ex.17 | 69 | 70 |
|---|---|---|---|---|---|---|---|---|
| A-1 | | 1 | 1 | 1 | 1 | 1 | 1 | 1 |
| B-6 | | 22 | | | | | 22 | 22 |
| B-7 | | | 22 | | | | | |
| B-8 | | | | 22 | | | | |
| B-9 | | | | | 22 | | | |
| B-10 | | | | | | 22 | | |
| G-1 | | 0.05 | 0.05 | 0.05 | 0.05 | 0.05 | | 0.01 |
| G-2 | | | | | | | 0.05 | |
| Common components | | I-1 | I-1 | I-1 | I-1 | I-1 | I-1 | I-1 |
| Deionized water | | Balance | Balance | Balance | Balance | Balance | Balance | Balance |
| (A)/(G) | | 20 | 20 | 20 | 20 | 20 | 20 | 100 |
| (B)/(A) | | 22 | 22 | 22 | 22 | 22 | 22 | 22 |
| (B)/(G) | | 440 | 440 | 440 | 440 | 440 | 440 | 2200 |
| Soft feel | Initial stage | 2.8 | 2.8 | 2.8 | 2.9 | 2.4 | 2.8 | 2.8 |
| | After storage | 2.6 | 2.6 | 2.6 | 2.7 | 2.4 | 2.6 | 2.2 |
| Smell after left undried | Initial stage | 1.2 | 1.2 | 1.6 | 1.8 | 1.0 | 1.3 | 1.9 |
| | After storage | 1.2 | 1.2 | 1.7 | 1.9 | 1.0 | 1.5 | 2.3 |
| Smell from cigarette | Initial stage | 1.1 | 1.1 | 1.1 | 1.1 | 1.3 | 1.3 | 1.4 |
| | After storage | 1.2 | 1.2 | 1.2 | 1.2 | 1.3 | 1.5 | 1.8 |

TABLE 15

Treatment compositions for textile goods (softener compositions) according to Examples and the evaluation results
(The unit of the numerical values of the composition is mass %.)

| Examples | 71 | 72 | 73 | 74 | 75 |
|---|---|---|---|---|---|
| A-1 | 0.2 | 1 | 1 | 1 | 0.05 |
| B-6 | 22 | 12 | 12 | 5 | 22 |
| B-7 | | | | | |
| B-8 | | | | | |
| B-9 | | | | | |
| B-10 | | | | | |
| G-1 | 0.04 | 0.05 | 0.01 | 0.01 | 0.05 |
| G-2 | | | | | |
| Common component | I-1 | I-1 | I-1 | I-1 | I-1 |
| Deionized water | Balance | Balance | Balance | Balance | Balance |
| (A)/(G) | 5 | 20 | 100 | 100 | 1 |
| (B)/(A) | 110 | 12 | 12 | 5 | 440 |
| (B)/(G) | 550 | 240 | 1200 | 500 | 440 |

TABLE 15-continued

Treatment compositions for textile goods (softener compositions) according to Examples and the evaluation results (The unit of the numerical values of the composition is mass %.)

| Examples | | 71 | 72 | 73 | 74 | 75 |
|---|---|---|---|---|---|---|
| Soft Feel | Initial stage | 2.8 | 2.3 | 2.3 | 1.8 | 2.8 |
| | After storage | 2.5 | 2.1 | 1.9 | 1.7 | 2.6 |
| Smell after left undried | Initial stage | 1.2 | 1.3 | 1.6 | 2.4 | 1.4 |
| | After storage | 1.2 | 1.3 | 2.8 | 3.2 | 1.4 |
| Smell from cigarette | Initial stage | 2.0 | 1.3 | 1.4 | 1.9 | 3.0 |
| | After storage | 2.0 | 1.4 | 1.7 | 2.1 | 3.2 |

TABLE 16

Treatment compositions for textile goods (softener compositions) according to Examples and Comparative Example, and the evaluation results (The unit of the numerical values of the composition is mass %.)

| Examples | | 76 | 77 | 78 | 79 | Comp. Example 12 |
|---|---|---|---|---|---|---|
| A-1 | | 1 | 1 | 1 | 1 | — |
| B-6 | | 22 | — | 5 | 22 | 22 |
| B-7 | | | | | | |
| B-8 | | | 22 | | | |
| B-9 | | | | | | |
| B-10 | | | | | | |
| G-1 | | | | | | 0.05 |
| G-2 | | | | | | |
| Antimicrobial-1 | | | | | 0.05 | |
| Common component | | I-1 | I-1 | I-1 | I-1 | I-1 |
| Deionized water | | Balance | Balance | Balance | Balance | Balance |
| (A)/(G) | | — | — | — | — | — |
| (B)/(A) | | 22 | 22 | 5 | — | — |
| (B)/(G) | | — | — | — | — | 440 |
| Soft Feel | Initial stage | 2.8 | 2.8 | 1.8 | 2.8 | 2.8 |
| | After storage | 1.6 | 2.0 | 0.6 | 1.6 | 2.6 |
| Smell after left undried | Initial stage | 2.4 | 2.8 | 3.4 | 1.8 | 1.6 |
| | After storage | 4.0 | 4.2 | 4.5 | 3.8 | 1.6 |
| Smell from cigarette | Initial stage | 1.2 | 1.2 | 1.9 | 1.2 | 3.9 |
| | After storage | 2.2 | 1.9 | 3.3 | 2.2 | 4.0 |

Examples 76 to 79 where the component (G) was not contained were inferior to those where the component (G) was contained with respect to the deodorizing and odor preventing effects after the storage of the composition at 40° C. for four months, but the deodorizing and odor preventing effects were found to be sufficient on the day after preparation.

The invention claimed is:

1. A treatment composition for textile goods, comprising;

(A) a glucan having an inner branched cyclic structure portion and an outer branched structure portion and having a degree of polymerization of 50 to 10,000, the inner branched cyclic structure portion being a cyclic structure portion formed from α-1,4-glucosidic bond and α-1,6-glucosidic bond, and the outer branched structure portion being a non-cyclic structure portion attached to the inner branched cyclic structure portion, (B) at least one compound selected from the group consisting of: an amine compound having in the molecule thereof 1 to 3 hydrocarbon groups with 10 to 26 carbon atoms, which may be separated by an ester group or an amide group; a salt thereof; and a quaternary compound thereof, and (C) one or more compounds selected from the group consisting of compounds (C-1) to (C-3):

(C-1): a fatty acid represented by $R^aCOOH$ wherein $R^a$ is an alkyl or alkenyl group having 8 to 35 carbon atoms, (C-2): a silicone compound, and (C-3): an aliphatic alcohol represented by $R^bOH$ wherein $R^b$ is an alkyl or alkenyl group having 8 to 35 carbon atoms.

2. The treatment composition for textile goods of claim 1, wherein the ratio by mass of the component (A) to the component (B), represented by (A)/(B), is 1/1000 to 1/1, and the ratio by mass of the component (A) to the component (C), represented by (A)/(C), is 1/100 to 100/1.

3. The treatment composition for textile goods of claim 1, wherein the component (C) consists of component (C-1) and at least one of component (C-2) and component (C-3).

4. The treatment composition for textile goods of claim 1, wherein the component (C) consists of component (C-2), and the component (C-2) is selected from the group consisting of polyether-modified silicone, amino-modified silicone and dimethyl silicone.

5. The treatment composition for textile goods of claim 1, further comprising (D) at least one water-soluble solvent selected from the group consisting of:

(i) alkanols, (ii) polyols, (iii) polyglycols, (iv) alkylethers, (v) aromatic ethers, and (vi) alkanolamines, with the ratio of (A)/(D) being in the range of 10/1 to 1/100.

6. The treatment composition for textile goods of claim 5, wherein the component (D) consists of at least one alkanol (i) and at least one other water-soluble solvent selected from the group consisting of (ii) to (vi)).

7. The treatment composition for textile goods of claim 5, further comprising (E) a sugar compound having a degree of polymerization of 40 or less.

8. The treatment composition for textile goods of claim 1, further comprising (F) an antioxidant.

9. The treatment composition for textile goods of claim 8, wherein the component (F) is contained in an amount of 0.001 to 5 mass %, and the component (A) is contained in an amount of 0.01 to 10 mass %, with the ratio of (F)/(A) being 5 or less.

10. The treatment composition for textile goods of claim 8, wherein the component (F) is a phenol antioxidant.

11. The treatment composition for textile goods of claim 8, wherein the component (F) is 3,5-di-t-butyl-4-hydroxytoluene (BHT), p-methoxyphenol or 2,2'-ethylidenebis(4,6-di-t-butylphenol).

12. The treatment composition for textile goods of claim 1, further comprising (G) a biguanide compound.

13. The treatment composition for textile goods of claim 1, which is a softener composition.

* * * * *

UNITED STATES PATENT AND TRADEMARK OFFICE

CERTIFICATE OF CORRECTION

PATENT NO. : 9,157,183 B2
APPLICATION NO. : 14/403361
DATED : October 13, 2015
INVENTOR(S) : Tomohiko Amatani et al.

It is certified that error appears in the above-identified patent and that said Letters Patent is hereby corrected as shown below:

In the Claims:
Claim 6, Column 60, Line 45: after "(ii) to (vi)" and before "." please delete ")"

Signed and Sealed this
Twelfth Day of April, 2016

Michelle K. Lee

Michelle K. Lee
*Director of the United States Patent and Trademark Office*